United States Patent [19]

Mattiola et al.

[11] Patent Number: 4,881,375

[45] Date of Patent: Nov. 21, 1989

[54] AUTOMATED CYLINDER TRANSFILL SYSTEM AND METHOD

[75] Inventors: Paul A. Mattiola, Coopersburg; James VanOmmeren, Werley's Corner, both of Pa.

[73] Assignee: Air Products and Chemicals, Inc., Allentown, Pa.

[21] Appl. No.: 320,730

[22] Filed: Mar. 8, 1989

Related U.S. Application Data

[62] Division of Ser. No. 111,532, Oct. 20, 1987.

[51] Int. Cl.[4] ..... F17C 13/00

[52] U.S. Cl. ..... 62/50.6; 417/20

[58] Field of Search ..... 62/50.1; 141/4, 5, 7, 141/65; 417/18, 20; 137/255

[56] References Cited

U.S. PATENT DOCUMENTS

| | | | |
|---|---|---|---|
| 2,440,981 | 5/1948 | Smith | 417/20 |
| 3,807,433 | 4/1974 | Byrd | 137/255 |
| 4,090,525 | 5/1978 | Potter | 62/50.6 |
| 4,257,745 | 3/1981 | Thur et al. | 417/18 |
| 4,273,164 | 6/1981 | Gunn | 141/7 |
| 4,320,788 | 3/1982 | Lord | 137/255 |
| 4,487,025 | 12/1984 | Hamid | 62/50.6 |
| 4,630,038 | 12/1986 | Jordan | 73/23 |
| 4,662,181 | 5/1987 | Brigham | 62/50.6 |
| 4,739,647 | 9/1988 | Monticelli, Jr. | 73/23 |

FOREIGN PATENT DOCUMENTS

| | | |
|---|---|---|
| 2839122 | 3/1980 | Fed. Rep. of Germany . |
| 58-85382 | 5/1973 | Japan . |

*Primary Examiner*—Ronald C. Capossela

*Attorney, Agent, or Firm*—Geoffrey L. Chase; James C. Simmons; William F. Marsh

[57] ABSTRACT

A system and method for loading liquid gases into a container includes supplying substance to a pump simultaneously with the evacuation of the container for cooling the pump down during evacuation and starting the pump motor when the pump has reached a low temperature determined in accordance with the pressure of the substance storage tank. An analyzer for detecting the presence of contaminants is coupled to the evacuation line in fluid communication with the substance removed from the cylinders. Cavitation during the loading operation is detected by monitoring the flow of substance from the pump. A plurality of containers of differing sizes are loaded simultaneously on the same manifold. An isolation valve is provided in the manifold for terminating flow of substance to smaller containers when the smaller containers are full while permitting substance to continue to flow to larger containers coupled to the manifold.

11 Claims, 23 Drawing Sheets

AUTOMATED CYLINDER TRANSFILL SYSTEM AND METHOD

This is a division of application Ser. No. 111,532, filed 10/20/87.

BACKGROUND OF THE INVENTION

1. Field of the Invention

This invention relates to the field of loading liquefied gases into cylinders.

2. Prior Art

Filling stations are used to vaporize liquid cryogenic substance for filling high pressure industrial and medical gas storage devices such as cylinders. The liquefied gas is stored in large storage tanks to periodically refill cylinders with high pressure gas which are then transported to the place of use.

Prior to the filling of the cylinders, the cylinders are evacuated to remove any remaining substance or contaminants from them. During a typical evacuation cycle a cylinder is first vented to atmospheric pressure and then, by means of a vacuum pump, drawn down to a very low pressure. However, a small amount of the substance may still remain in the cylinder after such an evacuation. If the cylinder contained a contaminant then the contaminant will be in the cylinder after filling. This is very undesirable because in many applications a very high standard of purity is required. Thus, it was known to try to determine whether there were any contaminants in the cylinder before filling and to perform additional evacuation cycles on the cylinder until the contaminant is removed. A prior art method of determining whether there were contaminants in the cylinder was to open the valve on the cylinder and sniff the gas released prior to evacuation. This was very undesirable because it was dangerous to the operator since unknown contaminants may have been in the cylinder. Additionally, it was dangerous because some of the product gases could cause an explosion Additionally, this "sniff test" was not very accurate. Typically, even experienced operators could not detect contaminants in a lower concentration than approximately fifty to one hundred parts per million. For some applications, this level is not satisfactory. Additionally, the operator could only detect contaminants that had an odor. Thus odorless gases could not be detected at all using this method.

In another aspect of filling, after evacuation, substance was loaded into the cylinders using a pump which withdrew substance from the storage container and forced it into the cylinders. These pumps were subject to cavitation in which gas bubbles within the pump provided less resistance to the pump than the liquid. The lower resistance caused the pump to move faster. As the pump moved faster it heated causing additional gas bubbles to form thereby providing positive feedback to the cavitation process. This cavitation process could damage or even destroy the pump. Thus it has been known in the prior art to try to prevent cavitation as well as to try to detect cavitation as quickly as possible and shut the pump down.

Additionally, in prior systems substance was not permitted to flow into the pump to cool the pump down until the evacuation of the cylinders was complete. Thus a time delay was incurred while waiting for the cool down process to be completed.

Even if the pump was sufficiently cooled down prior to starting the pump motor, cavitation could still occur later during the loading of the cylinder. One commonly used method in the prior art for preventing cavitation from damaging pumps was simply to manually shut down the pump when the operator heard banging noises from the pump indicating that the pump was entering cavitation. This method was unsatisfactory because even short periods of banging caused premature wearing of the pump. Additionally, if the operator was busy or had left the area and no one was there to hear the pump banging the pump could be destroyed.

One method known in the prior art for dealing with this problem was to monitor the pressure differential across the pump. If the difference between the pressure at the inlet of the pump and pressure at the outlet of the pump was not within a predetermined range, it could be determined that the pump was in cavitation or about to go into cavitation and the pump could be automatically shut down. However, this differential pressure method of detecting cavitation, while adequate for centrifigal pumps, was not a reliable way to detect cavitation in reciprocating pumps because of the different geometry of reciprocating pumps. Additionally, the pressure differential method was not reliable for higher pressure pumps and many applications could not be reached using lower pressure pumps.

It is also well known in the art of loading liquefied gases into cylinders to load a plurality of cylinders at one time using a single large manifold. In this method, the liquefied gas is supplied to the manifold and the various cylinders to be filled are attached to the manifold. It is also known to provide liquefied gas to a plurality of manifolds simultaneously wherein several cylinders may be coupled to each manifold. In many commercial applications it is desirable to load several different sizes of cylinders simultaneously. However, if different size cylinders are attached to a manifold at the same time, the smaller ones fill before the larger ones resulting in inefficiency. In the past determination was made when the smaller ones were full and the individual valves for the filled cylinders were closed to prevent additional substance from flowing into them while permitting substance to continue to flow into the larger cylinders. This was inaccurate because during the time required to close the valve of one of the smaller cylinders, substance continued to flow into other smaller cylinders. Thus the smaller cylinders would all be loaded with different amounts of substance. Furthermore, this method required an operator to be present and attending the cylinders until each was filled and then to close the valve.

In a still further aspect, after filling, the cylinders must be analyzed to determine whether they meet the specified level of purity. Testing of a single cylinder on a manifold is sufficient to test all the cylinders on the manifold. To perform this test, one of the cylinders was disconnected from the manifold and, in typical operations, placed on a cart and wheeled to a different location to be coupled to an analyzer. The analyzers were typically in a different location from the manifold because of the large size of these various pieces of equipment. This process was time consuming and laborious. In addition, since there are many different types of product gases as well as different cylinder pressures it was necessary to be careful to hook the cylinder up to the correct analyzer. Accidentally coupling a cylinder up to an incorrect analyzer may destroy the analyzer.

SUMMARY OF THE INVENTION

A system and method for loading liquid gases into a container includes supplying substance to a pump simultaneously with the evacuation of the container for cooling the pump down during evacuation and starting the pump motor when the pump has reached a low temperature determined in accordance with the pressure of the substance storage tank. An analyzer for detecting the presence of contaminants is coupled to the evacuation line in fluid communication with the substance removed from the cylinders. Cavitation during the loading operation is detected by monitoring the flow of substance from the pump. A plurality of containers of differing sizes are loaded simultaneously on the same manifold. An isolation valve is provided in the manifold for terminating flow of substance to smaller containers when the smaller containers are full while permitting substance to continue to flow to larger containers coupled to the manifold.

DESCRIPTION OF THE PREFERRED EMBODIMENT

General Description of the Invention

Figure 1:
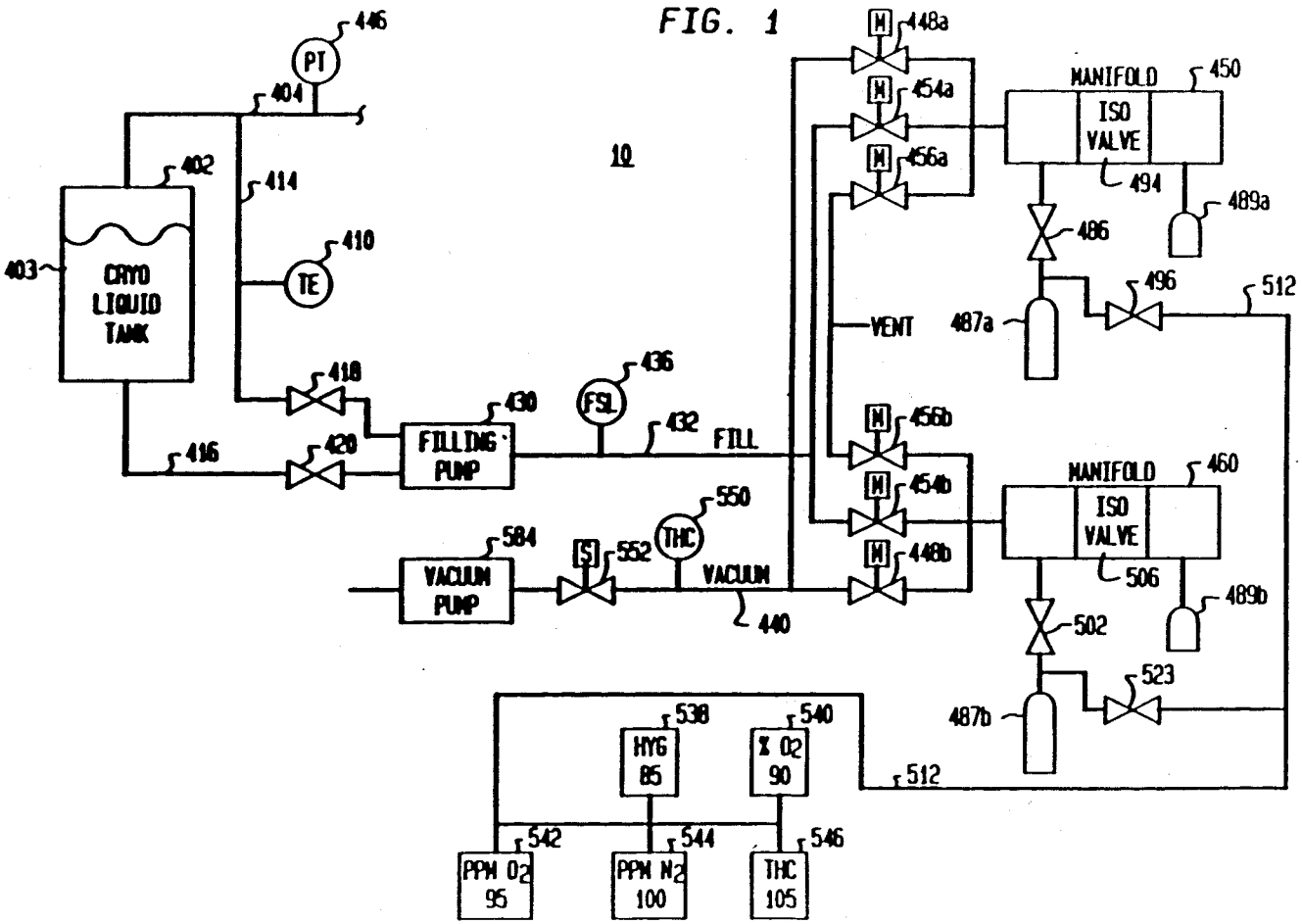
FIG. 1 shows a simplified diagram of the automated cylinder transfill system of the present invention.

Referring now to FIG. 1, there is shown automated cylinder transfill system 10. Cylinder transfill system 10 includes storage tank 402 containing cryogenic substance 403 and manifolds 450,460 for receiving substance 403 from tank 402 and supplying substance 403 to cylinders 487*a,b*, 489*a,b*.

During a filling operation when solenoid controlled valve 420 is open, substance 403 may flow through line 416 to filling pump 430. Filling pump 430 forces substance 403 through fill line 432 to manifolds 450, 460 when fill valves 454*a,b* are open.

Before a filling operation may be performed, cylinders 487*a,b*, 489*a,b* must be evacuated to remove any substance which may be present in them from a previous use. This prevents any contamination which may be in cylinders 487*a,b*, 489*a,b* prior to the filling operation from remaining when cylinders 487*a,b*, 489*a,b* are refilled. Thus cylinders 487*a,b*, 489*a,b* are vented to atmospheric pressure by momentarily opening valves 456*a,b*. Vacuum valves 448*a,b* are then opened during an evacuation cycle and vacuum pump 584 is actuated to withdraw unwanted substances in cylinders 487*a,b*, 489*a,b* through manifolds 450,460 and through vacuum line 440. This evacuation cycle may be repeated several times.

During the evacuation of cylinders 487*a,b*, 489*a,b*, a determination is made whether the substance contained in cylinders 487*a,b*, 489*a,b* contains any hydrocarbon contaminant. Thus as substance is drawn through vacuum line 440, the substance is analyzed by analyzer 550 which is coupled to vacuum line 440 between manifolds 450,460 and vacuum pump 584. If any contaminants are detected by analyzer 550 during evacuation, the evacuation may be repeated as necessary to remove the contaminants.

During an evacuation cycle solenoid controlled valve 420 may be opened to permit substance 403 to flow through line 416 to pump 430 in order to begin cooling of pump 430. This cooling is performed to prevent the formation of gas bubbles in pump 430 during the operation of pump 430 and thereby to prevent cavitation of pump 430. Thus the cooling of pump 430 to prevent cavitation may be performed simultaneously with an evacuation cycle of system 10.

Furthermore, if a plurality of evacuation cycles are being performed within system 10, system 10 may be programmed to determine when the next to the last evacuation cycle is being performed and begin cooldown of pump 430 during the next to the last evacuation cycle. This is accomplished by opening valve 420 to permit substance 403 to flow through line 416 to pump 430 during the next to the last evacuation cycle. This permits pump 430 to be actuated and the filling operation to be initiated immediately upon the completion of the last evacuation cycle thereby preventing any wasted time while waiting for pump 430 to cool down after evacuation.

A determination must be made by system 10 whether pump 430 is sufficiently cooled down by substance 403 before starting pump 430. Temperature transducer 410 is read to determine the temperature of pump 430. The optimum temperature for preventing cavitation is determined in accordance with the pressure within tank 402 as determined by pressure transducer 446 on line 404.

During the evacuation of cylinders 487a,b, 489a,b, a determination is made whether the substance contained in cylinders 487a,b, 489a,b contains any hydrocarbons. This determination must be made to guarantee meeting product specifications and for safety to prevent possible explosion. Thus as gas is drawn through vacuum line 440, the gas is analyzed by analyzer 550 which is coupled to vacuum line 440 between manifolds 450, 460 and vacuum pump 584. Analyzer 550 is selected to detect any flammable gas, even odorless flammable gases.

If pump 430 begins to cavitate during a loading operation, the flow of substance 403 through fill line 432 decreases. Therefore, flow switch 436 is coupled to fill line 432 for determining whether substance 403 is flowing through fill line 432 during a loading operation. Thus when pump 430 is operating, a determination may be made whether substance 403 is actually passing through fill line 432. If substance 403 is not passing through fill line 432 when pump 430 is actuated, system 10 determines that pump 430 is in cavitation and pump 430 is stopped and started in an attempt to correct the cavitation. After pump 430 has been stopped and restarted, another determination is made by means of flow switch 436 whether pump 430 is still in cavitation. If a flow of substance 403 through line 432 is not detected by flow switch 436, pump 430 is again stopped and restarted. If pump 430 is still in cavitation, as determined by again reading flow switch 436, pump 430 is again stopped and restarted. If pump 430 is stopped and restarted a predetermined number of times, for example three or four times, without curing the cavitation, pump 430 is stopped and not restarted and an alarm is sounded.

System 10 may automatically fill different size cylinders 487a,b, 489a,b. For example, cylinders 489a,b may be smaller than cylinders 487a,b. This is possible because isolation valves 494, 506 of manifold 450,460 respectively may be automatically closed by system 10 to prevent substance from flowing to smaller cylinders 489a,b while permitting substance 403 to continue to flow to larger cylinders 487a,b. Thus when system 10 determines that smaller cylinders 489a,b are full, isolation valves 494, 506 are actuated to prevent any additional substance 403 from flowing into cylinders 489a,b while substance 403 continues to flow into larger cylinders 487a,b.

It will be understood by those skilled in the art that a plurality of isolation valves 494, 506 may be provided within manifolds 450, 460 to permit the automatic filling of more than two different sizes of cylinder. Thus, for example, manifolds 450, 460 may be divided into three different sections by providing each manifold 450, 460 with two isolation valves each to permit the automatic filling of three different sized cylinders.

After the filling operation is complete, the substance loaded into cylinders 487a,b, 489a,b may be automatically tested by supplying a small amount of substance from within a cylinder 487a,b to one of a plurality of analyzers. Thus all of the cylinders coupled to a manifold 450, 460 are tested by testing one cylinder on each manifold 450, 460.

To perform this automatic analysis, manifolds 450, 460 are provided with motor controlled valves 486, 502 respectively. When the filling operation is complete and all valves controlling flow into and out of the inlets of manifolds 450, 460 are closed, motor control valve 486 is closed thereby isolating cylinder 487a from manifold 450 and motor controlled valve 502 is closed thereby isolating cylinder 487b from manifold 450 and any other cylinders which may be coupled to manifold 450, for example, cylinder 489a. Valve 496 in line 512 may then be opened to permit a small amount of substance 403 within cylinder 487a to be bled from cylinder 487a and to flow by way of line 512 to a selected one of a plurality of analyzers 538, 540, 542, 544, 546. Each analyzer is provided with an individual valve (not shown) to permit each analyzer to receive the flow of substance in line 512 under the control of system 10 independently of the remaining analyzers.

Similarily, solenoid valve 523 may be opened to permit small amounts of substance 403 to be bled from cylinder 487b. Substance 403 which is bled from cylinder 487b is applied by way of line 512 to a selected one of the analyzers as previously described. Thus the contents of the cylinders of manifold 460 may also be analyzed.

DETAILED DESCRIPTION OF THE INVENTION

Figure 2:
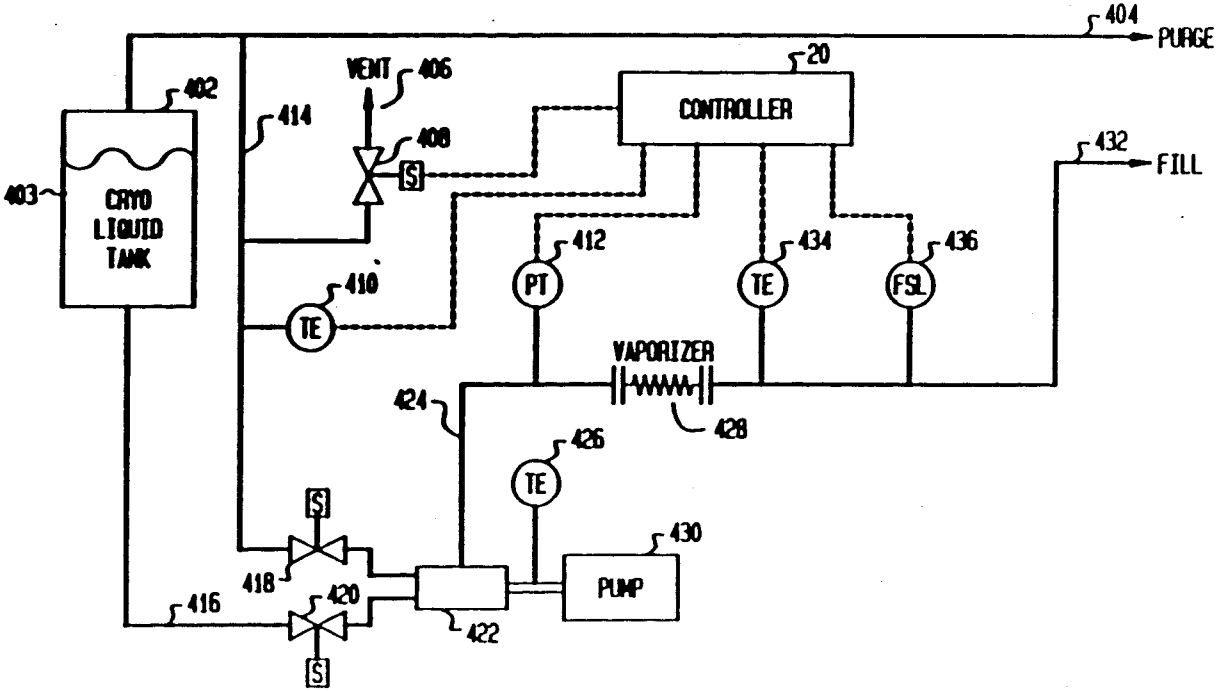
FIG. 2 shows a more detailed representation of a portion of the system of FIG. 1.

Referring now to FIG. 2, transfill system 10 consists of controller 20, a process control computer system, and hardware devices that allow for automated transfer of cryogenic substance 403 by way of line 416 from storage tank 402 through pump 430 and line 424 to vaporizer 428 and, by way of fill line 432, into cylinders attached to manifolds 450, 460.

Figure 22:
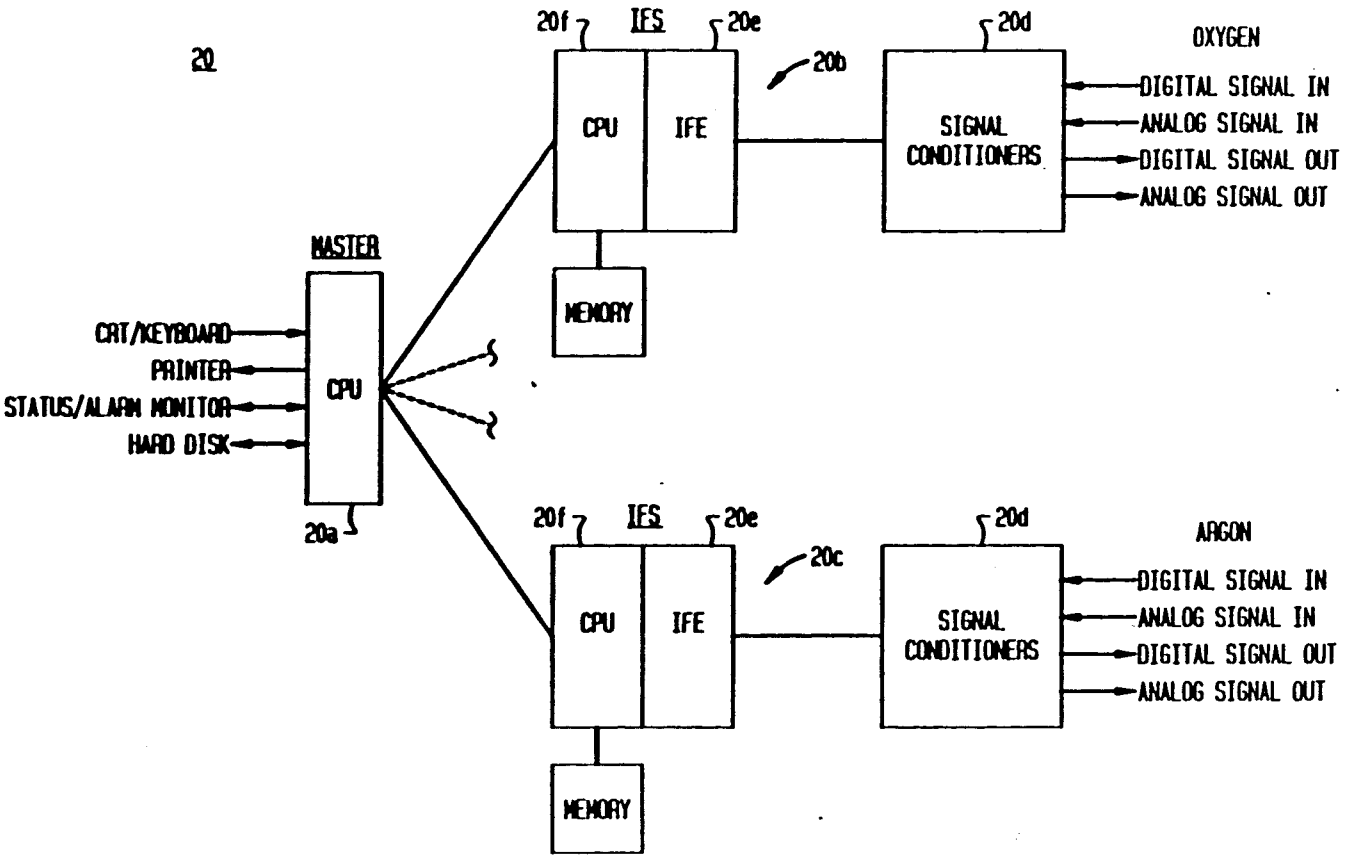
FIG. 22 shows a block diagram representation of a controller for controlling the operation of the system of FIG. 1.

While controller 20 is shown coupled to only a few transducers (for example transducers 410, 412, 434) for reading transducers and is shown coupled only to one solenoid valve (valve 408) for controlling valves, it will be understood by those skilled in the art that controller 20 may be coupled to all the transducers in system 10 for reading all the transducers and may be coupled to all solenoid controlled valves and motor controlled valves. The rest of the connections are not shown in order to simplify the drawing. A more detailed representation of controller 20 is shown in FIG. 22.

Additionally, it will be understood that transducers which provide analog outputs will be coupled to controller 20 by way of conditioning cards 20d in order to condition the output signals for application to controller 20. The solenoids, flow switches and limit switches on the motor valves of system 10 are digital and do not require any analog to digital or digital to analog conversion. Controller 20 may advantageously comprise an intelligent front end computer 20e such as the Intel ISBC 8840 and an Intel 8635 CPU board 20f, which, coupled together, may control the operations of system 10 for a single product gas. Thus the combination of the ISBC 8840 and the 8635 CPU board may be referred to as a single intelligent fill station 20b,20c. A plurality of such fill stations 20b,20c for controlling the loading of a plurality of different product gases may be supervised by a master supervisor computer 20a such as the Intel 86-310.

Figure 3:
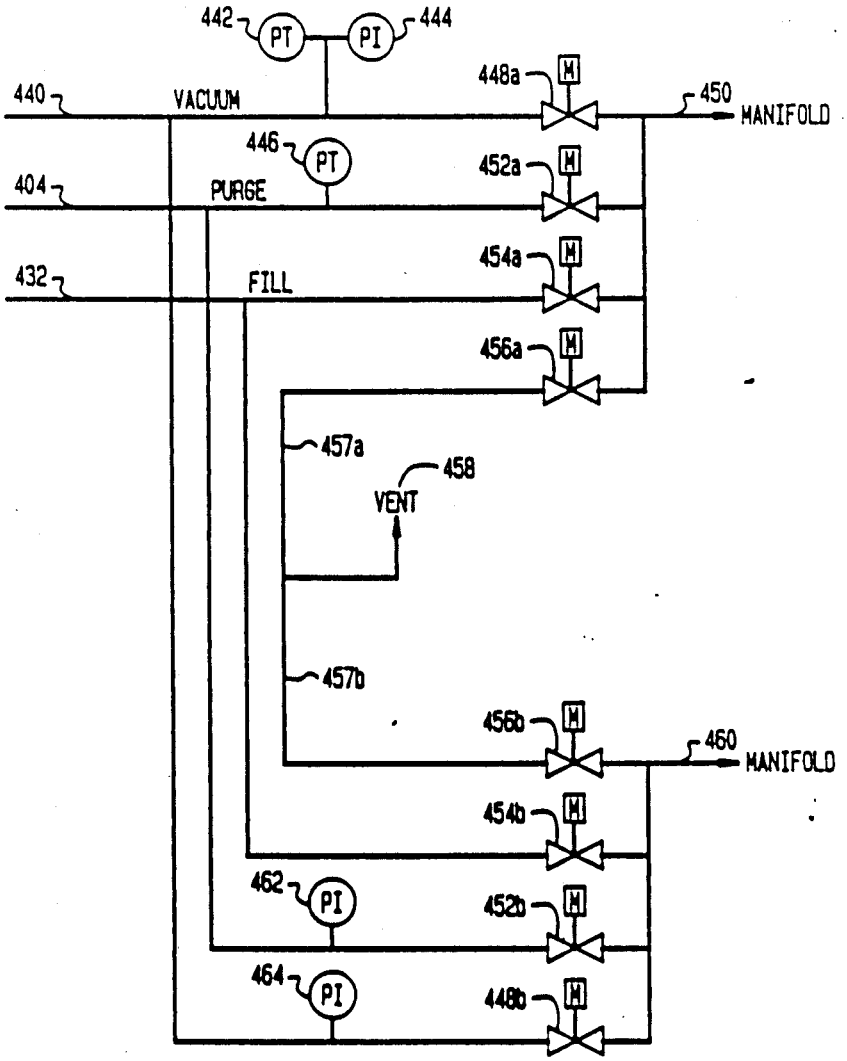
FIG. 3 shows a more detailed representation of a portion of the system of FIG. 1.

Substance 403 is loaded through line 432 by way of line 416 using pump 430. Manifolds 450, 460 are purged by way of purge line 404. FIG. 3 shows vacuum line 440 for providing vacuum for manifolds 450, 460; lines 404 for purging manifolds 450, 460; lines 432 to provide cryogenic substance 403 from tank 402 to fill manifolds 450, 460; and, lines 457a,b leading to vents 458, to allow venting of substance from manifolds 450,460 to atmosphere.

Figure 4:
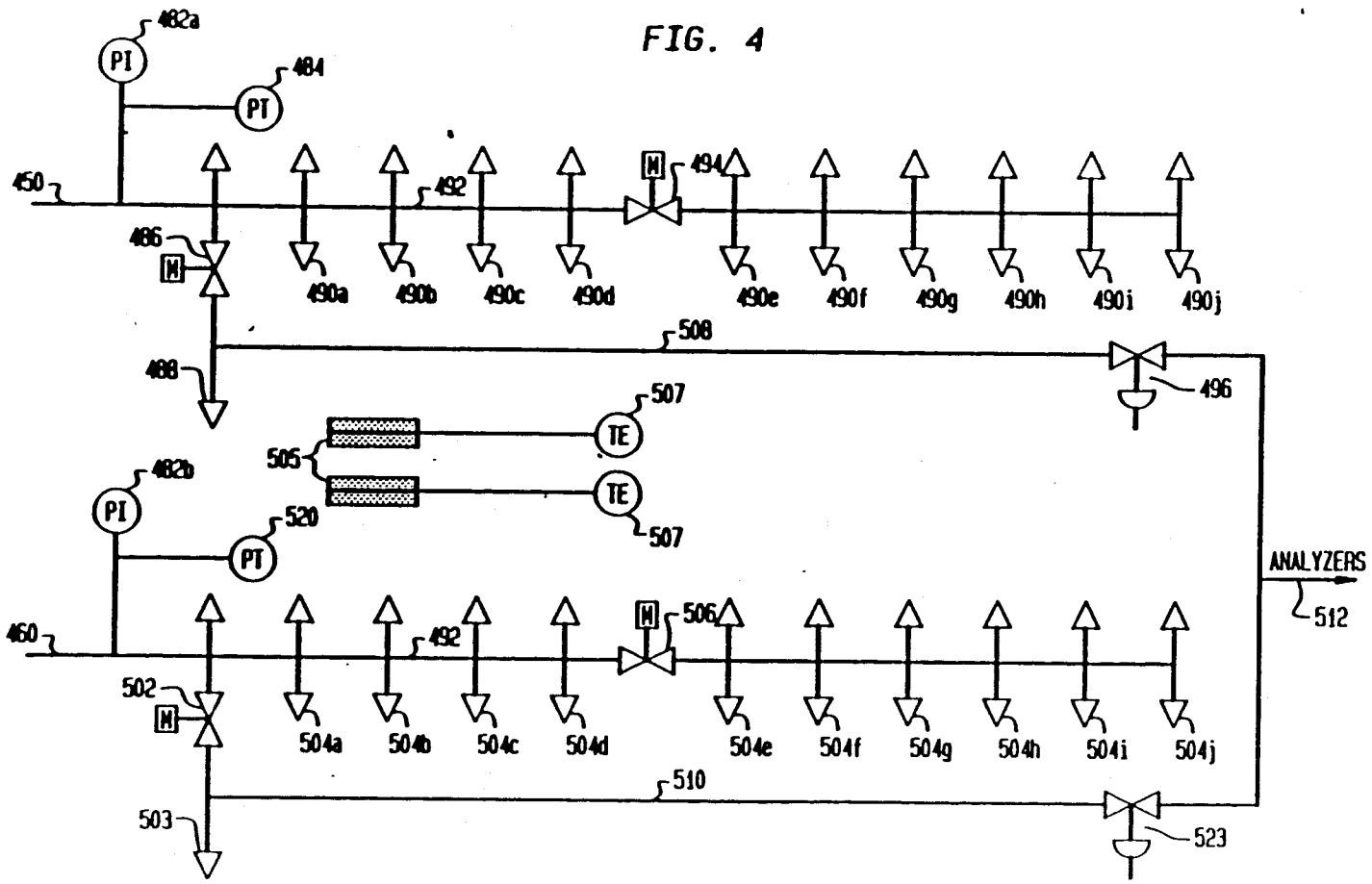
FIG. 4 shows a more detailed representation of a portion of the system of FIG. 1.

FIG. 4 shows manifolds 450, 460. Manifolds 450, 460 include valves 490a-j, 504a-j for coupling cylinders (not shown) to manifolds 450, 460 respectively and supplying substances to the cylinders.

Figure 5:
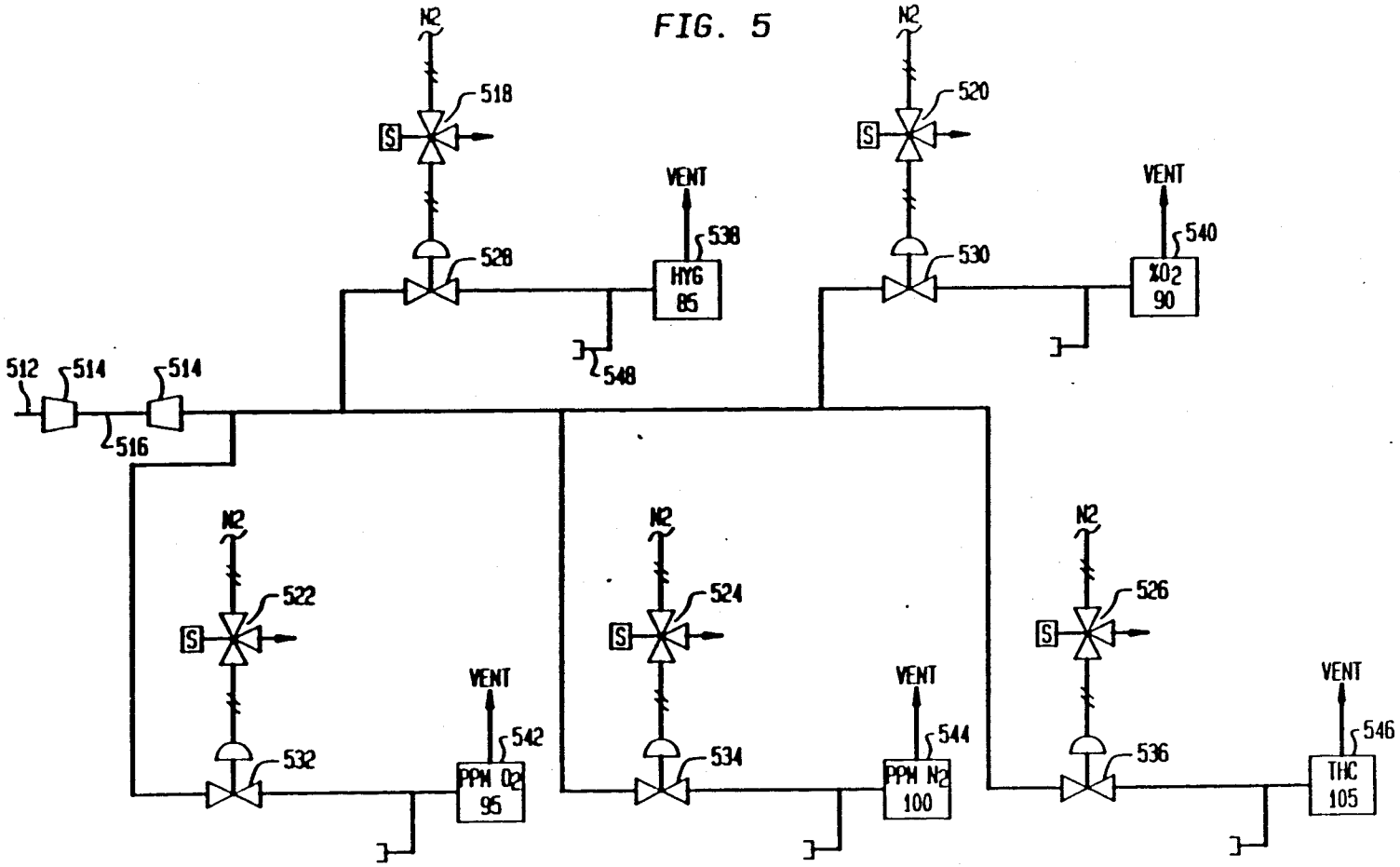
FIG. 5 shows a more detailed representation of a portion of the system of FIG. 1.

FIG. 5 shows analyzers 538, 540, 542, 544, and 546, used to determine if cryogenic substance 403 from cylinders attached to manifolds 450,460 is contaminated with inorganic contaminants and to determine the final product purity. Analyzers 538, 540, 542, 544, and 546, are coupled to manifolds 450, 460 by way of line 512.

Figure 6:
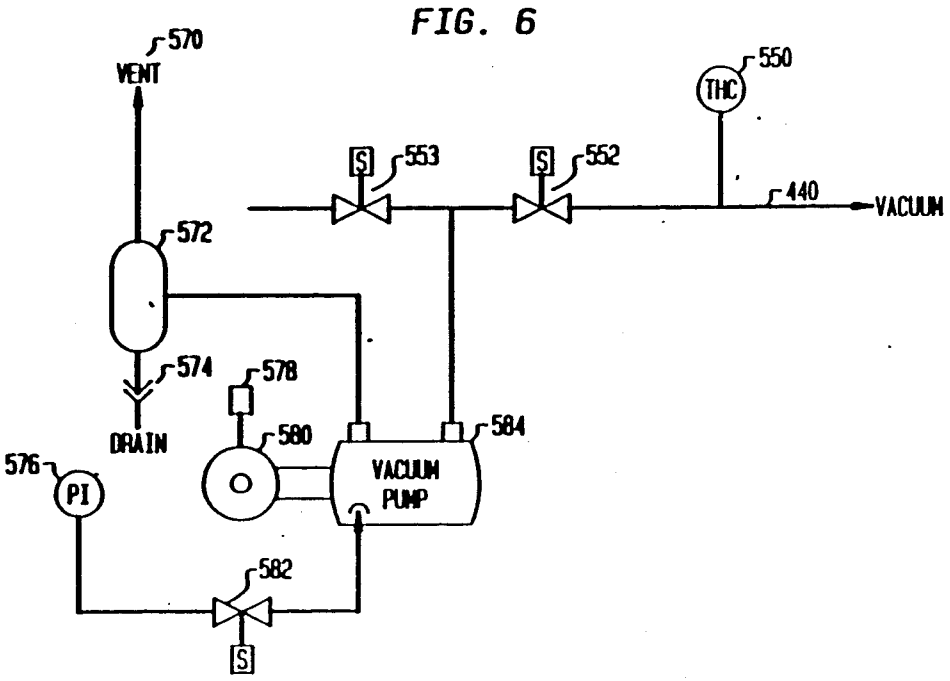
FIG. 6 shows a more detailed representation of a portion of the system of FIG. 1.

Referring now to FIG. 6, there is shown vacuum pump 584, vacuum line 440, vent 570. Vacuum pump 584 can be used to evacuate manifolds 450, 460 by way of line 440.

Figure 7:
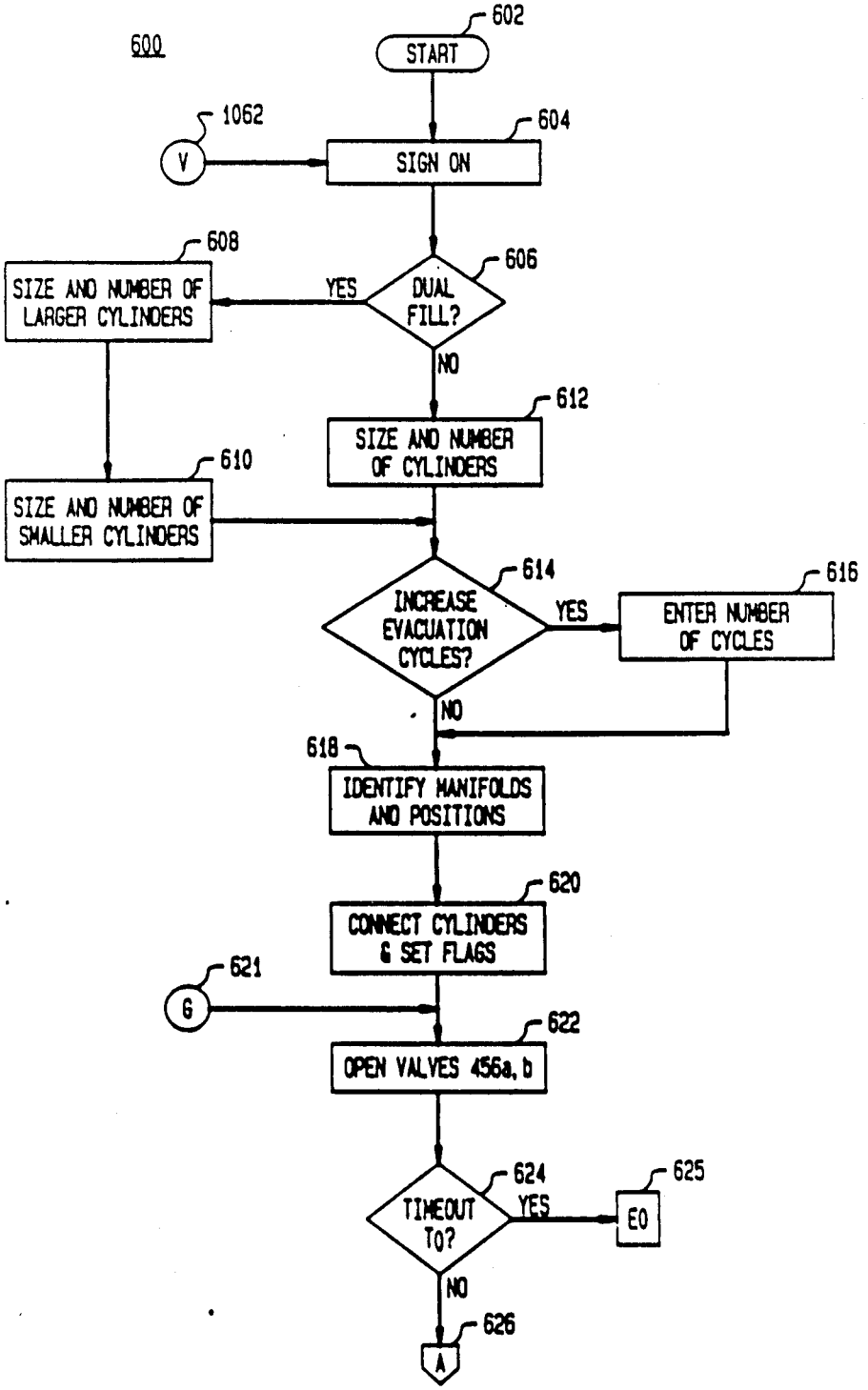
FIG. 7 shows a portion of the flow chart representing the programming of the system of FIG. 1.

Referring now to FIG. 7, flow chart 600 is a representation of the operations programmed and stored within controller 20 for controlling the operation of transfill system 10. The first step is signing on as shown in block 604. During the sign on, an operator may enter employee identification information and select various options relating to type and grade of substance 403 being transferred from storage tank 402 to the cylinder.

A determination is then made whether the dual fill feature is selected as shown in decision 606. This feature allows filling of various size cylinders which may be attached to manifolds 450, 460.

Depending on whether the dual fill is selected, as determined in decision 606, data is received in block 608 or block 612. If the dual fill is selected in decision 606, the size and number of larger cylinders are specified in block 608. The size and number of smaller cylinders are then specified in block 610. If dual fill was not selected, as determined in decision 606, the size and total number of cylinders is entered in block 612. The cylinders designated in block 612 must all be the same size.

A determination is then made by controller 20 whether the number of evacuation cycles is to be increased, as shown in decision 614. If the number of evacuation cycles is to be increased, the number of evacuation cycles is entered as shown in block 616.

In block 618, manifolds 450,460 which are active are identified to controller 20 as well as the positions 490a-j, 504a-j, (on the manifolds 450, 460 which are to be used). In block 620, the cylinders are connected to manifolds 450, 460 and internal flags are set.

As shown in box 622, controller 20 then opens valves 456a,b. Valves 456a,b allow venting of manifolds 450, 460.

Controller 20 then waits a predetermined period of time T0 to confirm the opening of the valves, as shown in decision 624. If, after predetermined time period TO valves 456a,b are not open, as determined in decision 624, error condition E0 is raised as shown in block 625.

Figure 8:
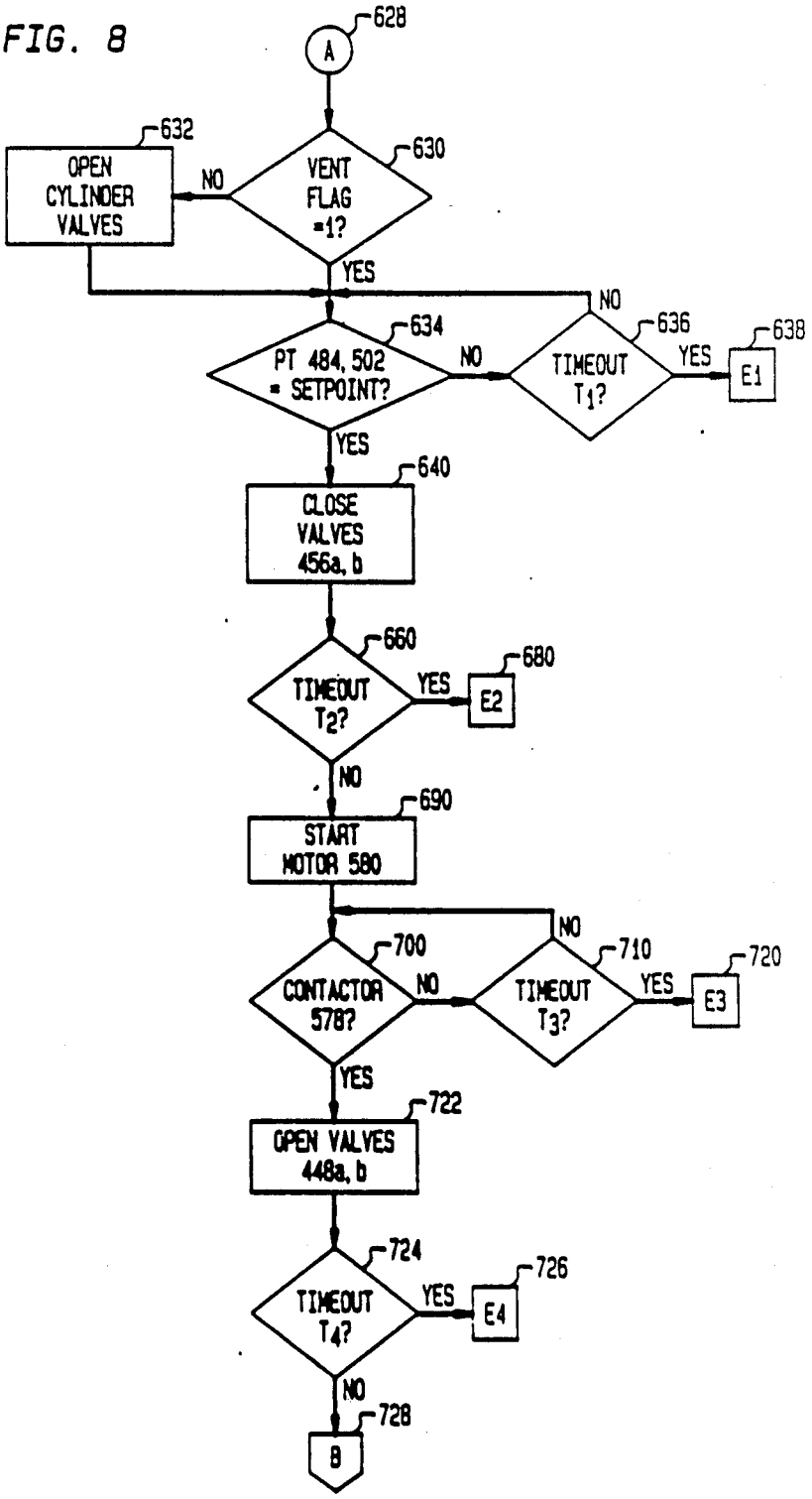
FIG. 8 shows a portion of the flow chart representing the programminq of the system of FIG. 1.

Referring now to FIG. 8, execution proceeds by way of off-page connector 626 to on-page connector 628. Controller 20 then determines if the cylinders already have been vented as shown in decision 630.

If the cylinders have not been vented, manual cylinder valves 488, 490-j, 503, 504a-j to which a cylinder (FIG. 4) is attached, are opened, one at a time, as shown in block 632. This sequential venting of the cylinders prevents contamination of empty cylinders by residual gases from other empty cylinders.

After valves 490a-j, 504a-j are opened, controller 20 determines the pressure of manifold 450, 460 using pressure transducers 484, 520. If only manifold 450 is in use, then only pressure transducer 484 is read. If only manifold 460 is in use, then only pressure transducer 520 is read. If after a period of time as set in block 636, the pressure of manifold 450,460 has not dropped, controller 20 determines that venting is not occurring, and error condition E1 shown in block 638, exists. The pressure determinations are made at decision 634 by comparing the pressure readings of transducers 484, 520 with predetermined pressure setpoints PT 484, 502.

When controller 20, reading the pressure of manifolds 450,460 from pressure transducers 484, 520 determines that venting is complete, as shown in decision 634, valves 456a,b are closed, as shown in block 640.

If valves 456a,b are not closed within predetermined period of time, (period T2 determined in decision 660), controller 20 raises error condition E2 as shown in block 680.

As shown in block 690, controller 20 then sends a signal to start motor 580. Motor 580 drives vacuum pump 584. Controller 20 monitors contactor 578 to see if the motor 580 has successfully started, as shown in decision 700. If, after a predetermined period T3, determined in decision 710, motor 580 has not started, controller 20 declares an error condition E3, as shown in block 720.

Controller 20 then opens valves 448a,b, which causes manifolds 450,460 and the attached cylinders to be evacuated by the vacuum created by pump 584.

A predetermined period of time T4 is allowed to determine whether valves 448a,b have fully opened. If after predetermined period T4 valves 448a,b have not fully opened, error condition E4 is declared, as shown in block 726.

Figure 9A:
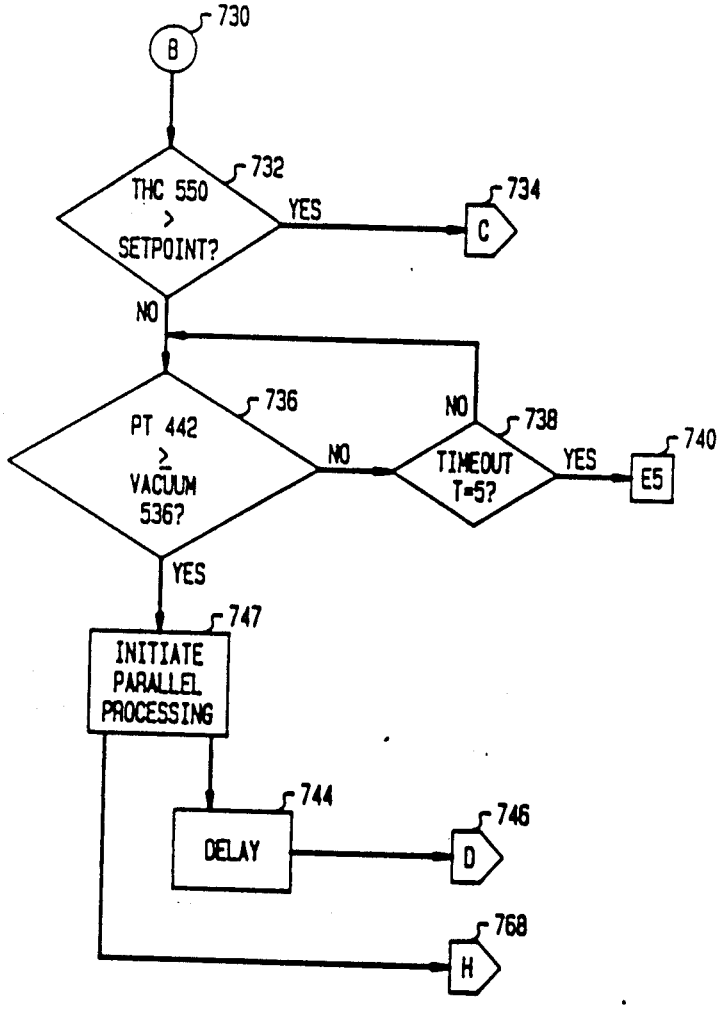
FIGS. 9A,B show a portion of the flow chart representing the programming of the system of FIG. 1.

Referring now to FIG. 9A, execution proceeds by way of off-page connector 728 to on-page connector 730. As shown in decision 732, analyzer 550 checks for the presence of total hydrocarbon (THC) gases in vacuum line 440. The presence of hydrocarbon gases indicates contamination of a cylinder connected to manifolds 450,460. If hydrocarbon gases are detected, controller 20 then branches to control routine by way of off-page connector 734. Thus, system 10 may detect the presence of odorless contaminants because analyzer 550 can be selected to detect any flammable gas whether odorless or not.

Figure 9B:
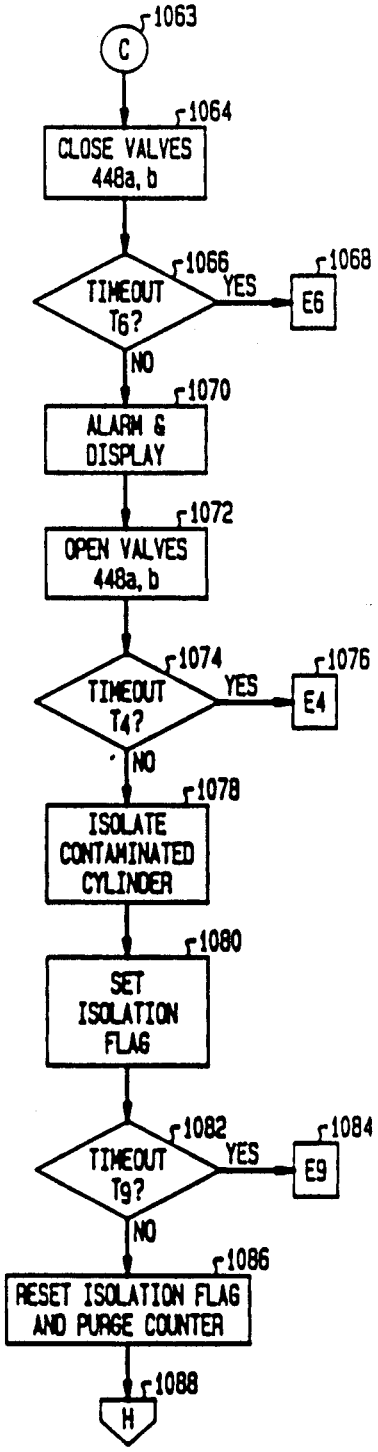

Referring now to FIG. 9B, execution proceeds by way of off-page connector 734 to on-page connector 1063. In block 1064, controller 20 closes valves 448a,b isolating manifolds 450,460 from vacuum line 440. In block 1066, controller 20 waits for the time-out period T6 to determine if valves 448a,b are closed. If they are not closed by the end of time period T6, error condition E6 is declared in block 1068.

In block 1070, controller 20 sets off alarms and issues a message to the operator indicating that a contaminated cylinder is connected to manifolds 450,460. Controller 20 prompts the operator to close the manual valves of cylinders connected to manifolds 450,460.

In block 1072, controller 20 opens valves 448a,b, connecting vacuum line 440 to manifolds 450, 460, removing contaminating gas from manifolds 450, 460 and zeroing analyzer 550. Controller 20 waits for time-out period T4, as shown in block 1074, to determine if valves 448a,b are opened If they are not open within time-out period T4, error condition E4 is declared in block 1076.

In block 1078, controller 20 prompts the operator to open manual valves attached to cylinders on manifolds 450, 460 one at a time and to acknowledge the openings. Controller 20 continues this process until the contaminated cylinder is isolated as shown in block 1078. When the contaminated cylinder is isolated, the isolation flag is set as shown in block 1080. The contaminated cylinder thus isolated is removed from manifolds 450, 460. Analyzer 550 may detect odorless gas as well as a gas with an odor, to concentrations of one to two parts per million.

In block 1082, controller 20 times the contamination isolation process of block 1078. If the isolation process of block 1078 is not complete during time-out period T9, error condition E9 is declared in block 1084.

When isolation is successfully completed, as shown in block 1086, controller 20 resets the isolation flag and purge counter. Processing then proceeds by way of off-page connector 1088.

If hydrocarbon gases are not detected in line 440 by decision 732, execution proceeds to decision 736 (FIG. 9A). In decision 736, controller 20 uses pressure transducer 442 to determine if a vacuum corresponding to a predetermined setpoint in pressure transducer 442 has been created in vacuum line 440. This predetermined setpoint may be twenty eight inches of mercury.

As shown in decision 738, if pressure transducer 442 does not detect the correct amount of vacuum in line 440 within predetermined time period T5, error condition E5 is declared by controller 20 in block 740.

If the correct amount of vacuum in line 440 is detected in decision 736, the vacuum in vacuum line 440 is broken by opening valve 553 and controller 20 then begins the execution of two parallel processes as indicated at block 747. The process proceeding from block 747 to delay block 744 is described below, after the description of the process proceeding from block 747 to off-page connector 768.

Figure 10:
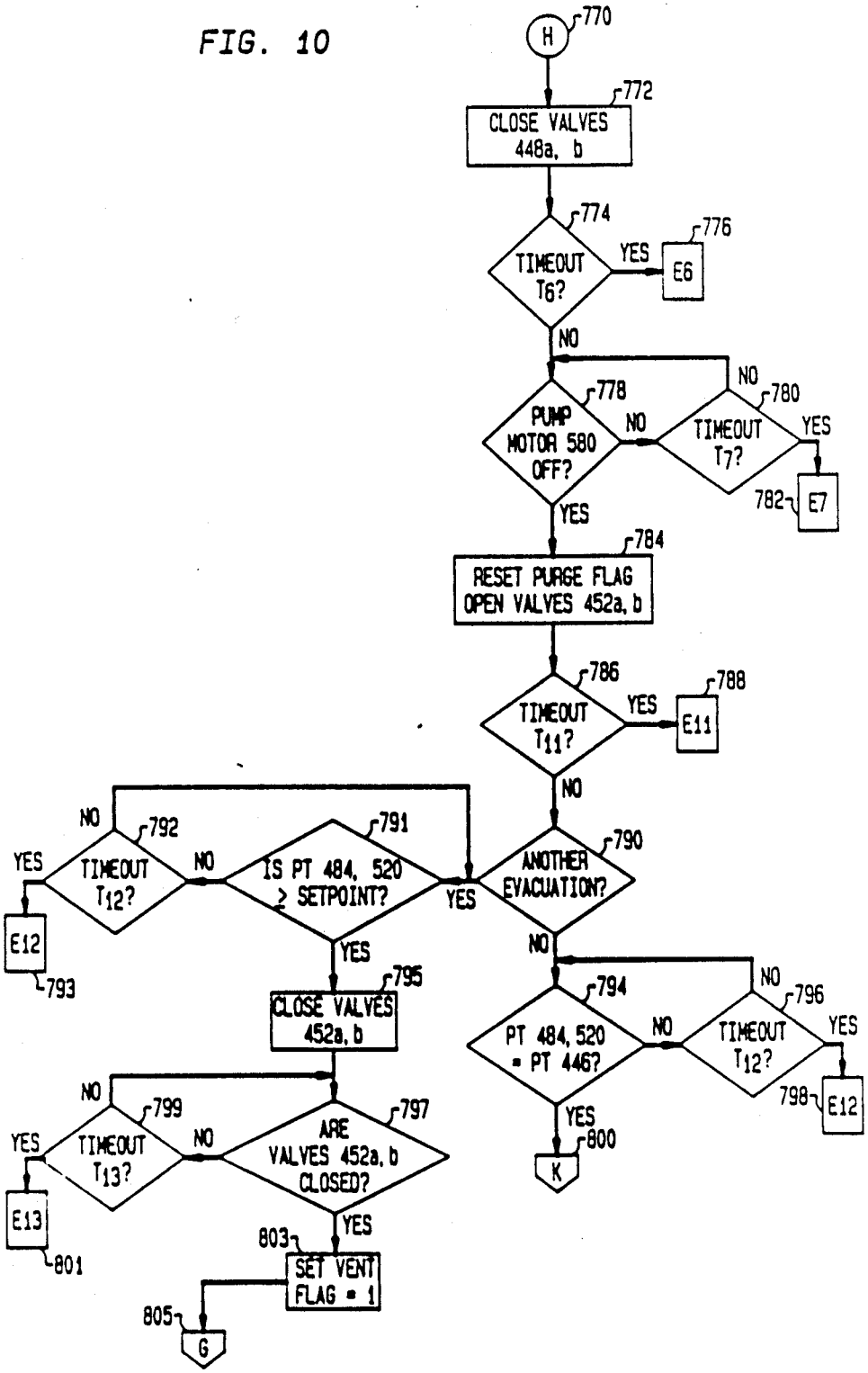
FIG. 10 shows a portion of the flow chart representing the programming of the system of FIG. 1.

Proceeding from block 747, the logic flow then proceeds by way of off-page connector 768 to on-connector 770 of FIG. 10. Controller 20 will by this routine cause the purging of manifolds 440, 450 and cylinders attached to valves 488, 490*a–j*, 503, 504*a–j*.

In block 772, controller 20 closes valves 448*a,b*. Block 774 waits a predetermined period of time T6 to determine whether valves 448*a,b* are successfully closed If they are not closed after time period T6, error condition E6 results, as shown in block 776.

Controller 20 then checks to see if pump motor 580 is turned off, as shown in decision 778. If within predetermined period of time T7, pump motor 580 is not turned off as determined by decision 780, error condition E7, as shown in block 782, results.

If pump motor 580 (FIG. 6) is turned off, the purge flag in controller 20 is reset and valves 452*a,b* are opened, as shown in block 784. This allows cryogenic substance from tank 402 to pass from purge line 404 into manifolds 450, 460 and to enter cylinders attached to valves 490*a–j*, 504*a–j*, causing the cylinders to be purged Controller 20 waits a predetermined period of time T11 to determine if valves 452*a,b* are opened, as shown in decision 786. If valves 452*a,b* are not open, error condition E11, shown in block 788, results. It will be understood that when loading certain substances the cylinders are not purged with substance.

In block 790, a determination is made whether another evacuation is required. If another evacuation is required, controller 20 branches to decision 791 to determine if pressure transducers 484,520 detect pressure in manifolds 450,460 equal to or greater than predetermined pressure setpoints. As shown in block 792, if the pressure setpoints of decision 791 are not reached after predetermined period T12, error condition E12 is declared, as shown in block 793. If the pressures detected by pressure transducers 484, 520 are equal to the setpoints, controller 20 closes fill valves 452*a,b* as shown in block 795. Controller 20 monitors closing of valves 452*a,b* as shown in decision 797. As determined in decision 799, if after predetermined period T13, valves 452*a,b* are not closed, error condition E13 is declared in block 801. If valves 452*a,b* close successfully as determined by decision 797, the flag is set as shown in block 803. Processing then passes to off-page connector 805.

If another evacuation is not required, as determined at decision 790, controller 20 waits for a predetermined period of time T12 in decision 796 to determine if pressure transducers 484, 520 show values equal to the value of pressure transducer 446. If after the predetermined period of time T12, pressure transducers 482*a,b* don't show pressure equal to the setpoint as determined in decision 794, error condition E12, as shown in block 798, results. Execution then proceeds by way of off-page connector 800.

Figure 11:
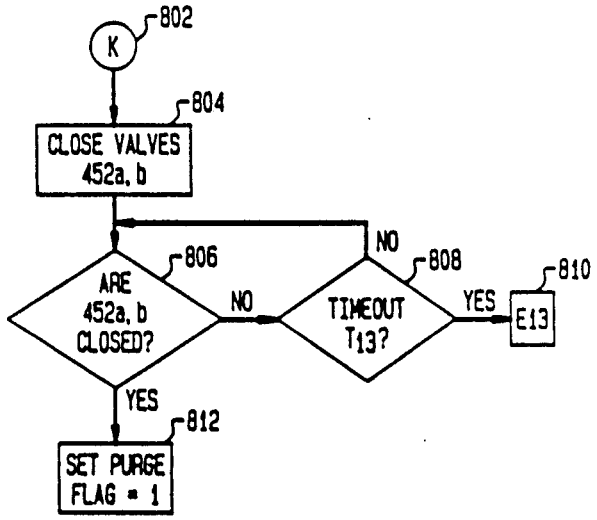
FIG. 11 shows a portion of the flow chart representing the programming of the system of FIG. 1.

Referring now to FIG. 11, execution proceeds by way of on-page connector 802. In block 804, controller 20 closes valves 452*a,b*. In decision 806, controller 20 determines whether valves 452*a,b* are closed. In decision 808, controller 20 waits a predetermined period of time for valves 452*a,b* to close. If they are not closed after time T13, as determined by decision 808, error condition E13 of block 810 exists. In block 812, controller 20 determines that purging has been successfully completed, and the purge flag is set.

Figure 12:
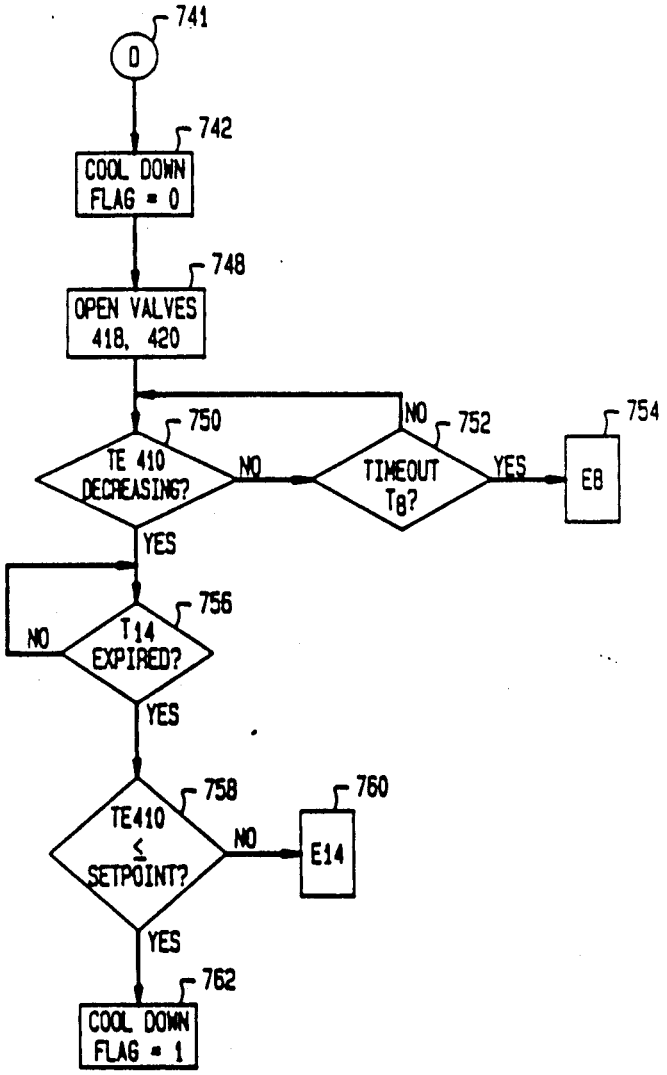
FIG. 12 shows a portion of the flow chart representing the programming of the system of FIG. 1.

Referring to FIG. 12, the process proceeding from block 747 through delay block 74 to off-page connector 746 is described, This process causes cooldown of pump 430. Overheating of pump 430 or a leak of pump 430 is detected by reading temperature transducer 426. The process logic follows the branch beginning with block 747 through off-page connector 746, to FIG. 12, on-page connector 741.

Controller 20 resets cool down flag as shown in block 742. Controller 20 then opens valves 418,420, allowing cryogenic substance 403 from tank 402 to flow through pipe 416 into pump 430, and vapor to return to tank 402 through line 414 (FIG. 2). This cools pump 430 and prevents cavitation. Cooldown of pump 430 may be begun during evacuation of the cylinders attached to the manifold.

In decision 750, a determination is made whether temperature transducer 410 located in vapor return pipe 414 to monitor the temperature of the gas within line 414, indicates decreasing temperature. As indicated in decision 752, if the temperature in line 414 does not begin to decrease after a predetermined period of time T8, error condition E8 is declared in block 754.

If controller 20 has determined in decision 750 that line 414 is cooling, a determination is made whether a predetermined amount of time T14 has expired, as shown in decision 756. Actuation of a filling station pump in response to the pump temperature reaching a predetermined level is disclosed in copending application Ser. No. 888,655 filed July 22, 1986, by J. VanOmmeren titled *Method and System for Filling Liquid Containers* and assigned to the assignee herein. This application is incorporated by reference herein.

In copending U.S. patent application Ser. No. 888,655, substance was allowed to flow into the pump before the pump was started in order to permit the substance to cool the pump down. If the pump is sufficiently cooled, the formation of gas bubbles within the pump is less likely. Thus the temperature of the pump was monitored as the cryogenic substance flowed into it and the pump motor was not started until a predetermined low temperature was reached. However, the time which passed while waiting for the pump to reach the predetermined low temperature was on occasion longer than what was absolutely required to avoid cavitation if the liquefied gas in the storage tank was at a relatively high pressure.

After time T14 shown in decision 756 has elapsed, controller 20 then uses temperature transducer 410 to determine if the substance in line 414 has cooled to a predetermined temperature setpoint, as shown in decision 758. The temperature setpoint is determined in accordance with the pressure within tank 402 as sensed by pressure transducer 446. In general, the lower the pressure in tank 402 the lower the required temperature setpoint. If the temperature setpoint has not been reached, error condition E14 of block 760 is declared. The temperature setpoint required for starting pump 430 may be determined according to the following equation:

$$T = \left(A + \frac{B}{P} + \frac{C}{P^2} + \frac{D}{P^3} + \frac{E}{P^4} + \frac{F}{P^5}\right) - 459.6 \quad \text{(equ 1)}$$

where P is the pressure in tank 402 and T is the liquid temperature in degrees F. The values of the coefficients depend on the substance 403 being loaded and sample values are shown in Table 1 for nitrogen, oxygen and argon.

TABLE 1

| Coefficient | $N_2$ | $O_2$ | Ar |
|---|---|---|---|
| A | 234.23 | 267.72 | 262.32 |
| B | −10,395 | −11,447 | −11,468 |
| C | 646,299 | 710,417 | 713,064 |
| D | −21,494,016 | −23,617,314 | −23,722,539 |
| E | $3.4349 \times 10^8$ | $3.7738 \times 10^8$ | $3.792 \times 10^8$ |
| F | $-2.0375 \times 10^9$ | $-2.2385 \times 10^9$ | $-2.2498 \times 10^9$ |

Figure 21:
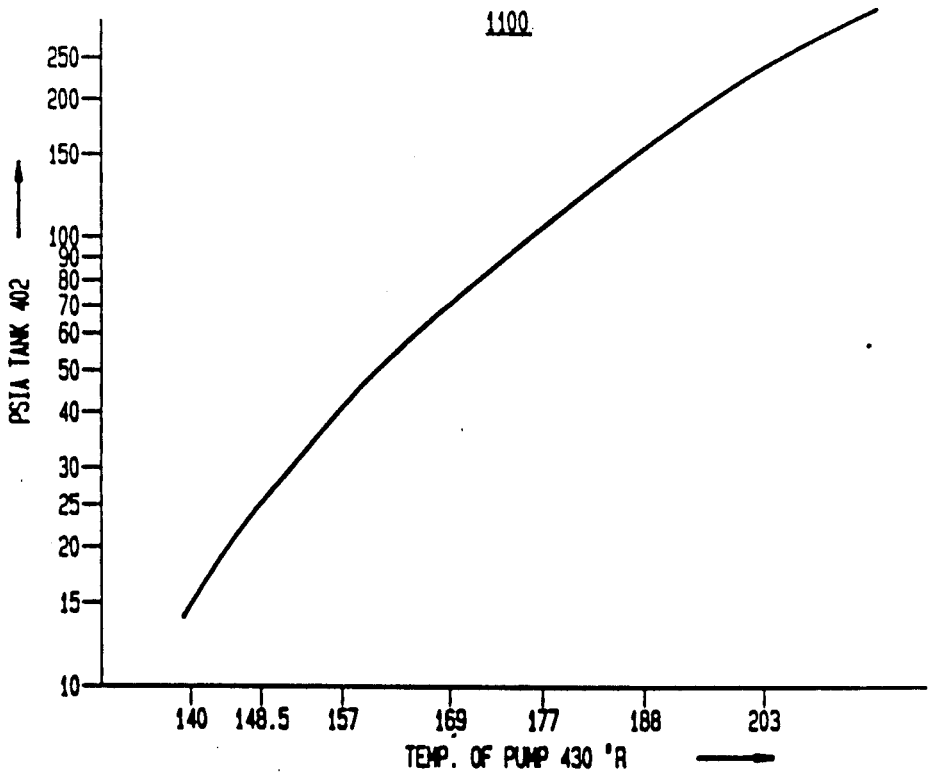
FIG. 21 shows a graphical representation of pump cool down temperature versus storage tank pressure.

Values of the setpoint temperature of pump 430 may be calculated in accordance with equation 1 or may be approximated according to conventional curve fitting methods and stored within controller 20 for later table lookups. The relationship between the setpoint temperature of pump 430 and the pressure of tank 402 is shown as graph 1100 in FIG. 21.

If controller 20 determines by use of temperature transducer 410 that the temperature in line 414 has reached the setpoint of decision 758, it assumes that pump 430 has been cooled down sufficiently to prevent cavitation, and the cool down flag is set as shown in block 762.

Figure 13:
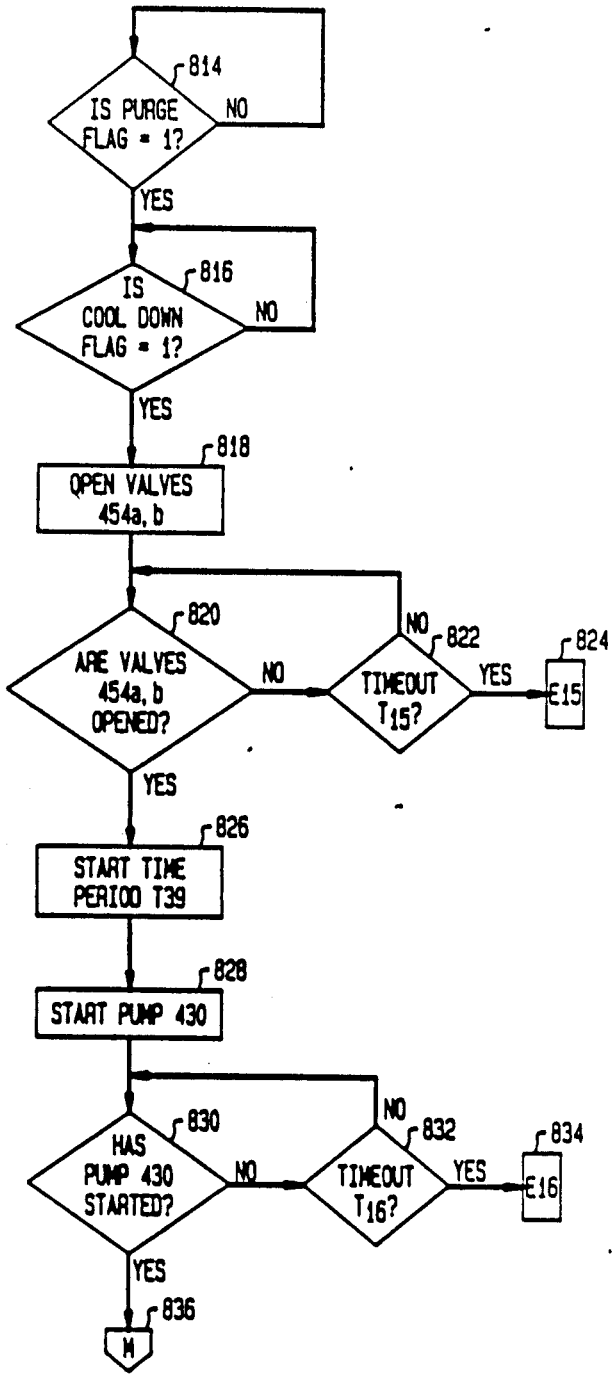
FIG. 13 shows a portion of the flow chart representing the programming of the system of FIG. 1.

Referring now to FIG. 13, controller 20 now checks in decisions 814, 816 for the successful completion of the two parallel tasks begun in block 747. If these tasks are not complete in a predetermined period of time an error is raised and an alarm is sounded. In decision 816, a determination is made whether the cool down task, begun with block 744, is completed successfully. In decision 814, a determination is made whether the purge task leading to connector 746 is completed successfully. Valves 454*a,b* are opened in block 818 if both tasks are complete.

In decision 820, a determination is made whether valves 454*a,b* are opened. As shown in decision 822, if valves 454*a,b* are not opened after predetermined period T15, error condition E15 is declared in block 824.

Controller 20 then begins to keep time of the fill period by initializing time period T39, as shown in block 826. As shown in block 828, pump 430 is then started. Pump 430 causes cryogenic liquid 403 from tank 402 to pass through line 416, through pump 430 then through line 424 into vaporizer 428. Vaporizer 428 converts cryogenic liquid into gas which then passes through line 432 into manifolds 450,460, through valves 490*a–j*,504*a–j*, filling attached cylinders with gas.

As shown in decision 830, a determination is made whether pump 430 is running. If after period T16, pump 430 is not running as determined by decision 832, error condition E16 is declared in block 834. Execution then proceeds to off-page connector 836.

Figure 14:
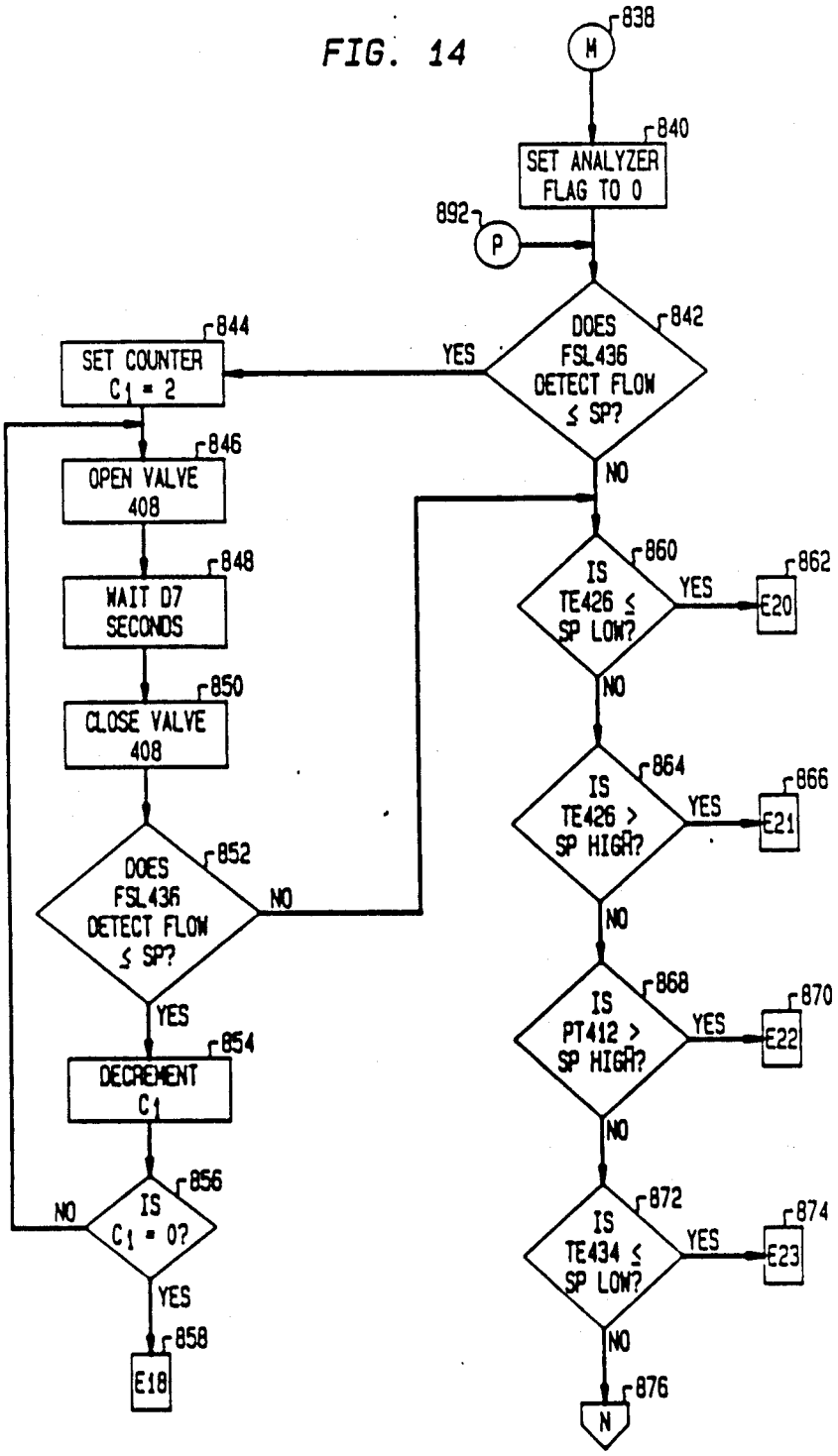
FIG. 14 shows a portion of the flow chart representing the programming of the system of FIG. 1.

Referring now to FIG. 14, execution proceeds by way of on-page connector 838 from off-page connector 836. In block 840, the analyzer flag is reset. In decision 842, a determination is made from flow switch 436 whether the flow of substance 403 through line 432 is less than a predetermined setpoint. If flow is less than the predetermined setpoint, processing proceeds to block 844 where counter C1 is set to 2. Valve 408 is then opened as shown in block 846, venting line 414. Controller 20 waits for predetermined period of time D7, as shown in block 848, before closing valve 408 as shown in block 850.

In decision 852, a determination is again made from flow switch 436 if flow of substance 403 in line 432 is less than the predetermined setpoint. If flow is greater than the setpoint, processing proceeds to decision 860.

If the flow of substance 403 is less than the setpoint as determined in decision 852, controller 20 decrements counter C1 in block 854. In decision 856, controller 20 determines whether counter C1 is equal to zero, indicating that this routine has run twice. If C1 is equal to zero, then error condition E18 is raised in block 858. If C1 is not equal to zero, as determined in decision 856, processing logic proceeds to block 846.

In decision 842, if controller 20 determines that flow switch 436 detected flow above a predetermined level, processing logic proceeds to decision 860. In decision block 860, controller 20 checks temperature sensor 426 which is mounted on pump 430 to determine if the temperature of pump 430 is below a low setpoint of temperature sensor 426, indicating leakage of cryogenic substance 403. If temperature sensor 426 detects temperature below a low setpoint, error condition E20 is declared in block 862.

In decision 864, controller 20 checks temperature sensor 426 to determine if the temperature of pump 430 is above a high setpoint of temperature sensor 426, indicating excessive heating of pump 430 caused by friction. If temperature sensor 426 detects temperatures above the high setpoint, error condition E21 is declared in block 866.

In decision 868, controller 20 checks pressure transducer 412 for pressures in excess of a high setpoint. Excessive pressure could indicate an obstruction downstream of pump 430. If pressure in excess of PT 412 high setpoint are detected, error condition E22 is declared in block 870.

In decision 872, controller 20 checks the temperature at temperature sensor 434 to determine if the fluid that passes out of vaporizer 428 is below a low setpoint of temperature sensor 434. Temperatures below the low setpoint indicate that vaporization of cryogenic substance 403 might not have been accomplished in vaporizer 428. If temperatures below the temperature sensor 403 low setpoint are detected, error condition E23 is declared in block 874. Processing logic then proceeds to off-page connector 876.

Figure 15:
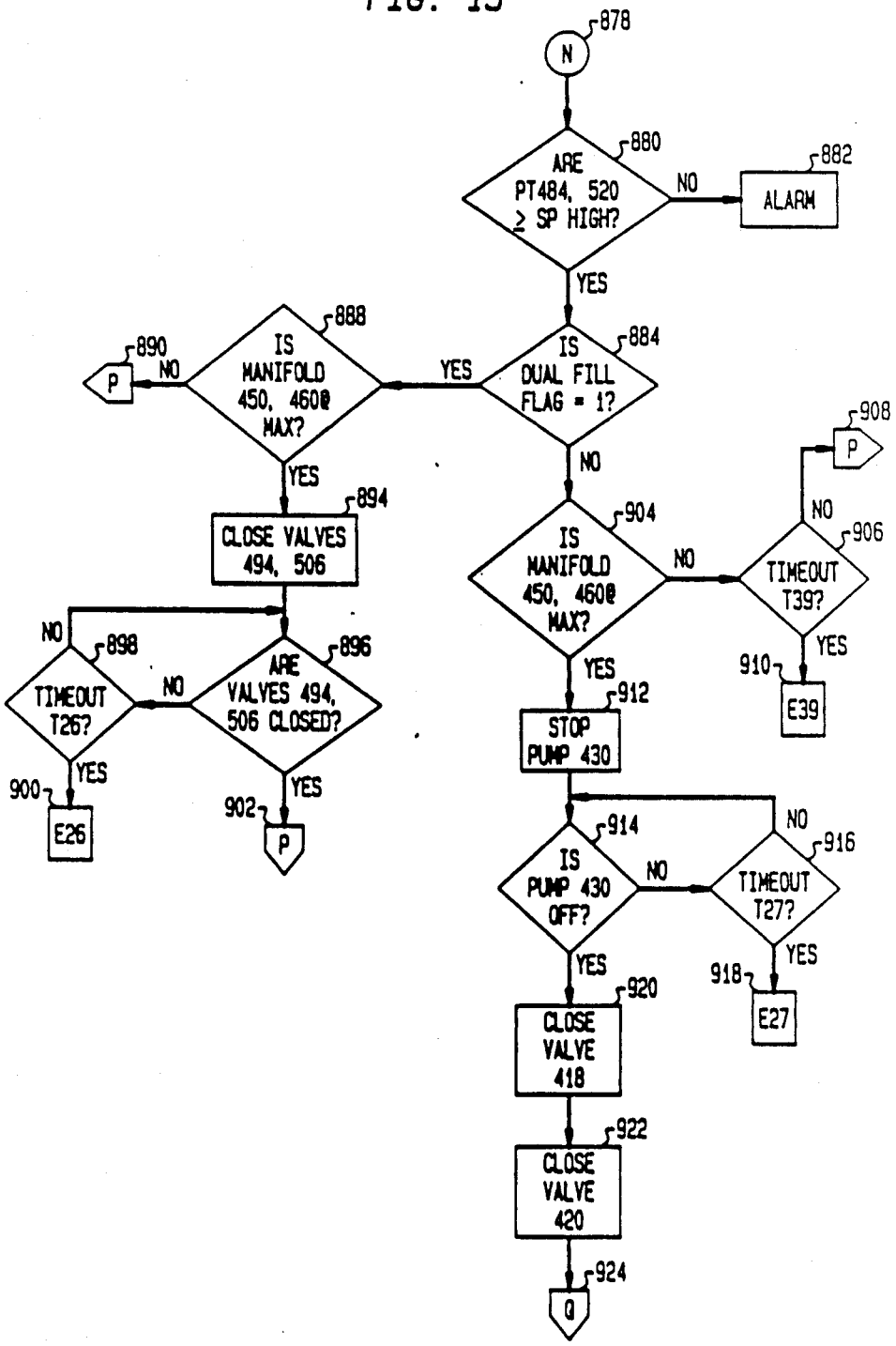
FIG. 15 shows a portion of the flow chart representing the programming of the system of FIG. 1.

Referring now to FIG. 15, execution proceeds by way of on-page connector 878. In decision 880, controller 20 checks pressure transducers 484, 520 against high set points. If it is determined that the pressures are not above the setpoints then the pressures are not building as cylinders attached to manifolds 450, 460 are filled and alarms are given in block 882.

In decision 884, the dual fill flag of block 606 is checked to determine if two sizes of cylinders are connected to manifolds 450, 460. If a dual fill operation is being performed as determined by decision 884, processing logic proceeds to decision 888.

At decision 888, the manifold pressures 450, 460 are read from pressure transducers 484 and 520, as well as cylinder temperatures from thermocouples 507. Thermocouples 507 provide a signal representative of the temperature of resistor elements 505 which are strapped to cylinders 487*a,b*. Using an algorithm, a determination is made whether the pressure readings from pressure transducers 484, 520 and the temperature of thermocouples 507 indicate that filling is complete. If filling is not complete, execution proceeds to off-page connector 890.

The algorithm which may be used for determining whether filling is complete is:

$$P = A + \frac{B}{T} + \frac{C}{T^2}$$

where T is the cylinder wall temperature in degrees R and P is the rated cylinder full pressure in psig. The values of the coefficients A, B, C depend on the type of cryogenic substance 403 as well as the rated cylinder full pressure and are shown in Table 2.

When using the algorithm, a determination is first made whether the pressure at the outlet of pump 430 is too high and an emergency shutdown is performed if this pressure is too high If the emergency shutdown is not performed, the pressure of a full cylinder is calculated as shown in the above equation using the temperature value determined by thermocouples 507 strapped to the cylinders being filled. This calculated value of pressure is then multiplied by an adjustment factor of ninety-eight percent and the result of the multiplication is compared with the measured pressure as determined by pressure transducers 484, 520. When the measured pressure exceeds ninety-eight percent of the calculated pressure, pump 430 is stopped.

A value of ninety-eight percent of the calculated pressure is used in determining when to stop pump 430 in order to allow for high pressure gas trapped in the fill lines and manifolds to bleed into the cylinders being filled. When pump 430 is stopped, there is a delay of approximately two minutes before closing fill valves 454*a,b* to allow some of the trapped gas to be redistributed into the cylinders.

Since the trapped gas is allowed to bleed into the cylinders, venting and blowdown losses are reduced. In one example, system 10 has been calculated to save approximately two percent of the product gas. Additionally, this permits an allowance for a period of time to close fill valves 454*a,b* while preventing overfilling due to the gas which bleeds into the cylinder wile the valves are being closed. This is useful if valves 454*a,b* are manual valves rather than automatic valves. It will be understood by those skilled in the art that the ninety eight percent adjustment factor and the delay time may be modified upwards or downwards depending on the volume of the flowpath, i.e., the volume of the fill lines and the manifolds.

TABLE 2

| Cylinder P Rating (PSIG) | Co-efficient | N2 | O2 | Ar |
|---|---|---|---|---|
| 1800 | A | 6205.3 | 6511.9 | 6376.6 |
| | B | −3,433,415 | −3,685,781 | −3,563,546 |
| | C | $5.8275 \times 10^8$ | $6.3040 \times 10^8$ | $6.0366 \times 10^8$ |
| 1980 | A | 6941.8 | 7281.8 | 7160.9 |
| | B | −3,876,187 | −4,145,306 | −4,041,418 |
| | C | $6.6110 \times 10^8$ | $7.0833 \times 10^8$ | $6.8722 \times 10^8$ |
| 2015 | A | 7063.0 | 7427.2 | 7311.0 |
| | B | −3,938,088 | −4,229,030 | −4,132,245 |
| | C | $6.6976 \times 10^8$ | $7.2172 \times 10^8$ | $7.0300 \times 10^8$ |
| 2216 | A | 7878.1 | 8321.9 | 8178.9 |
| | B | −4,419,437 | −4,772,215 | −4,649,668 |
| | C | $7.5242 \times 10^8$ | $8.1481 \times 10^8$ | $7.9004 \times 10^8$ |
| 2265 | A | 8078.5 | 8557.8 | 8433.8 |
| | B | −4,538,428 | −4,921,365 | −4,820,861 |
| | C | $7.7294 \times 10^8$ | $8.4140 \times 10^8$ | $8.2288 \times 10^8$ |
| 2492 | A | 9004.0 | 9586.8 | 9407.4 |
| | B | −5,083,924 | −5,548,274 | −5,395,460 |
| | C | $8.6538 \times 10^8$ | $9.4787 \times 10^8$ | $9.1725 \times 10^8$ |
| 2400 | A | 8645.3 | 9150.6 | 8995.3 |
| | B | −4,877,624 | −5,271,701 | −5,142,472 |
| | C | $8.3155 \times 10^8$ | $8.9857 \times 10^8$ | $8.7367 \times 10^8$ |
| 2640 | A | 9624.5 | 10,271.0 | 10,070.0 |
| | B | −5,450,014 | −5,961,450 | −5,789,745 |
| | C | $9.2733 \times 10^8$ | $1.0168 \times 10^9$ | $9.8241 \times 10^8$ |

If the filling of the smaller cylinders 489*a,b* is complete, as determined in decision 888, valves 494, 506 are closed as shown in block 894. This isolates the end of manifolds 450, 460 to which were attached smaller cylinders which are now full and permits filling of larger cylinders 487*a,b*.

In block 896, a determination is made whether valves 494,506 are closed If valves 494, 506 are not closed in time period T26, as determined in decision 898, error condition E26 is raised in block 900. If valves 494, 506 are closed, manifolds 450, 460 are configured to fill the remaining larger cylinders and execution proceeds to connector 902.

If dual fill is not selected, as determined in decision 884, processing proceeds to decision 904. In decision 904, manifold 450, 460 pressures are read from pressure transducers 484, 520 and cylinder temperatures are read from thermocouple 507. Using a custom algorithm, a determination is made whether the pressure readings of transducers 484, 520 and the temperature transducer 507 indicate that filling is complete.

If filling is not complete, as determined in decision 904, execution proceeds to decision 906 where a determination is made whether time period T39 of block 826 has elapsed. Time period T39 measures the filling time. If T39 has not elapsed, processing proceeds to block 908 and from there to on-page connector 892 to complete filling operation. In block 910, if period T39 has elapsed, error condition E39 is declared.

If a determination is made in block 904 that the fill is complete, execution proceeds to block 912. In block 912, pump 430 is stopped because the correct amount of cryogenic substance 403 from tank 402 has been transferred to cylinders attached to manifolds 450, 460.

In block 914, a determination is made whether pump 430 is off. If pump 430 is not off within time-out period T27 as determined in decision 916, error condition E27 is raised in block 918.

If pump 430 is off within time-out period T27, processing proceeds to block 920, and controller 20 closes valve 418 in the vapor return line 414 from pump 430 to tank 402. In block 922, controller 20 closes valve 420 in line 416 from tank 402 to pump 430.

At this point, the transfer of substance 403 from tank 402 to cylinders attached to manifolds 450, 460 is complete and pump 430 is turned off. The controller 20 now begins the analysis routine. Processing now proceeds through off-page connector 924.

Figure 16:
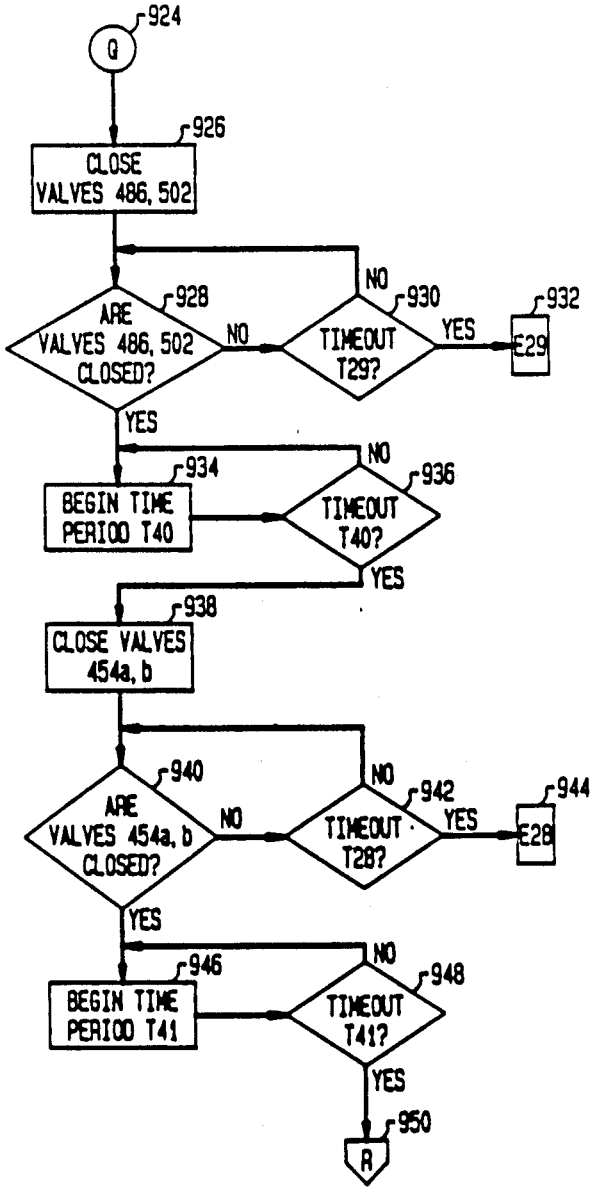
FIG. 16 shows a portion of the flow chart representing the programming of the system of FIG. 1.

Referring now to FIG. 16, execution proceeds by way of on-page connector 924. In block 926, controller 20 closes valves 486, 502 isolating test cylinders attached to valves 488, 503 from manifolds 450, 460. In decision 928, controller 20 tests to see if valves 486, 502 have been successfully closed If valves 486, 502 have not closed within time-out period T29, as determined in decision 930, error condition E29 is declared in block 932.

In block 934, controller 20 begins timing period T40. Timing period T40 ensures boil off of liquid remaining in lines 424, 432. Block 936 resumes the process at the completion of time-out T40.

In block 938, controller 20 closes valves 454*a,b*, isolating manifolds 450,460 from line 432. In decision 940, controller 20 checks to see if valves 454*a,b* are closed. If after time-out period T28, valves 454*a,b* are not closed, as determined by decision 942, error condition E28 is declared in block 944.

Controller 20 then begins timing period T41 in block 946. Completion of timing period T41 in decision block 948 ensures that manifolds 450,460 are free of gas from line 432 remaining after valves 454*a,b* have been closed. This ensures that gas from the cylinder attached to valve 488 is analyzed. Substance flows from the cylinders being tested to the analyzers by way of line 512. Line 512 reducer system 514 including restriction 516 to decrease the velocity of oxygen gas to prevent the danger of an explosion. Processing now proceeds through off-page connector 950.

Figure 17:
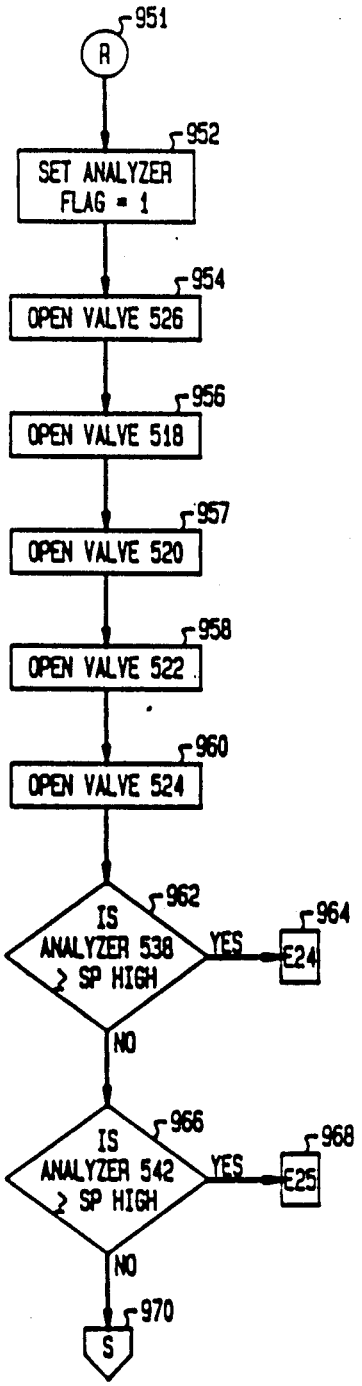
FIG. 17 shows a portion of the flow chart representing the programming of the system of FIG. 1.

Referring now to FIG. 17, execution proceeds by way of on-page connector 951. Controller 20 sets the analyzer flag in block 952 and first opens valves 496, 523 and then opens valve 526 in block 954; valve 518 in block 956; valve 520 in block 957; valve 522 in block 958; and valve 524 in block 960.

In decision 962, hygrometer analyzer 538 is tested to determine whether the moisture content of gas from the test cylinder attached to valve 488 exceeds the high setpoint for analyzer 538. If moisture levels equal or exceed the high setpoint for analyzer 538, error condition E24 is declared in block 964.

In decision 966, controller 20 trace oxygen analyzer 542 to determine whether the oxygen content of substance from the cylinder attached to valve 488 exceeds the high setpoint of analyzer 542. If the oxygen level equals or exceeds high setpoint for analyzer 542, error condition E25 is declared in block 968. Execution then proceeds to off-page connector 970.

Figure 18:
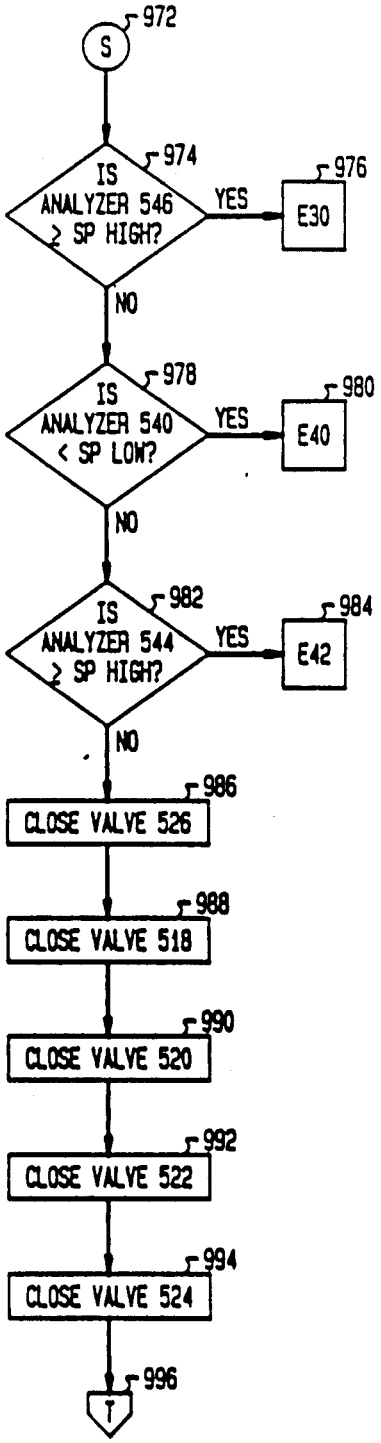
FIG. 18 shows a portion of the flow chart representing the programming of the system of FIG. 1.

Referring now to FIG. 18, execution proceeds by way of on-page connector 972. In decision 974, controller 20 checks total hydrocarbon (THC) analyzer 546 to see if the THC content of substance from the cylinder attached to valve 488 is greater than the high setpoint of analyzer 546. If THC levels equal or exceed the high setpoint for analyzer 546, error condition E30 is declared in block 976.

In decision 978, oxygen gas percent analyzer 540 is read to determine whether the oxygen percent of substance from the cylinder attached to valve 488 is less than the low setpoint of analyzer 540. If the oxygen gas percent equals or is less than the setpoint for analyzer 540, an error condition E40 is declared in block 980.

In decision 982, controller 20 checks nitrogen gas analyzer 544 to see if the trace nitrogen gas content of substance from the cylinder attached to valve 488 exceeds the high setpoint of analyzer 544. If nitrogen gas levels equal or exceed the high set-point for analyzer 544, error condition E42 is declared in block 984 and controller 20 first closes 496, 523. Controller 20 then closes valve 526 in block 986; valve 518 in block 988; valve 520 in block 990; valve 522 in block 992; and valve 524 in block 994. Processing then proceeds to off-page connector 996.

Figure 19:
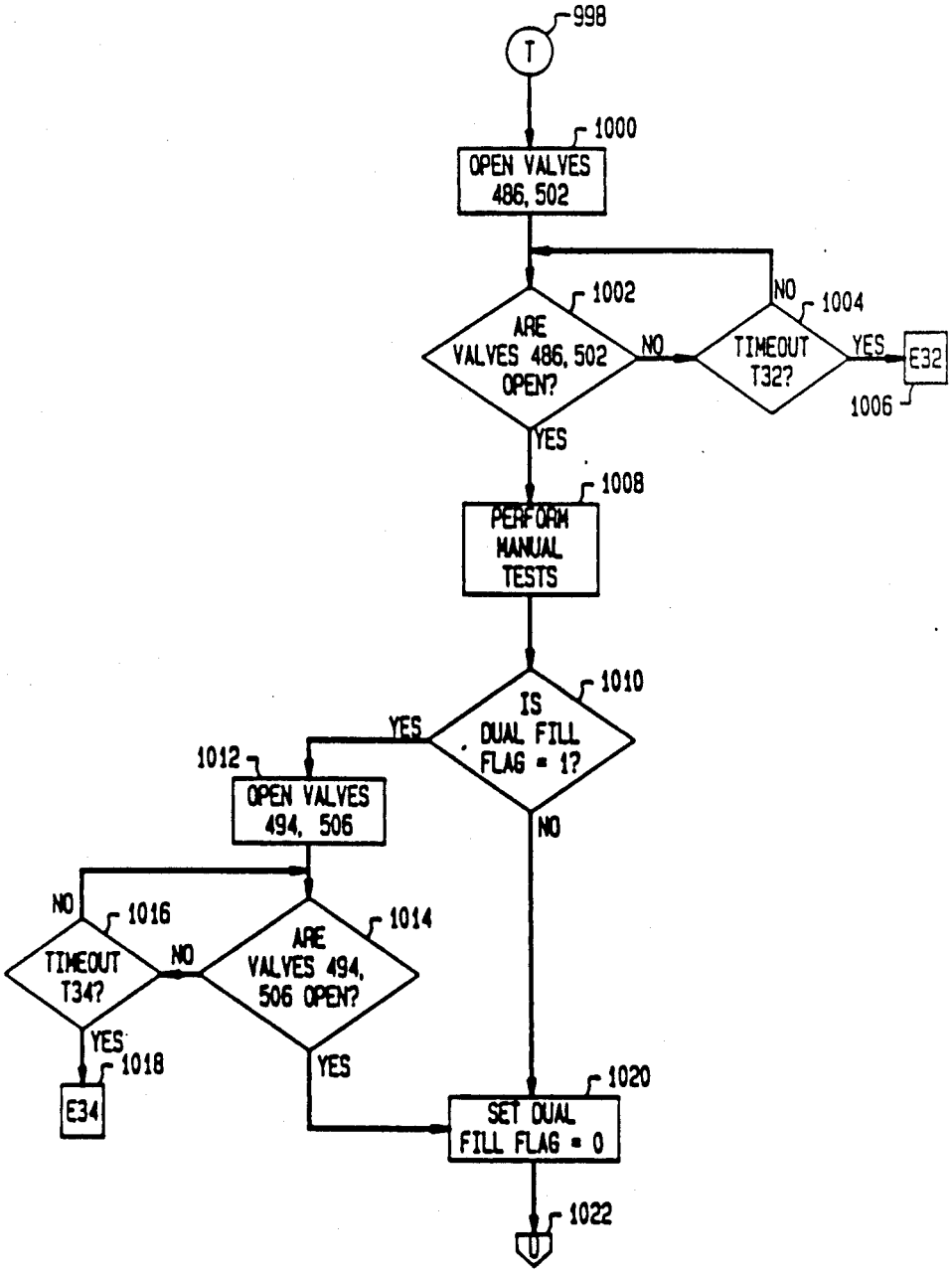
FIG. 19 shows a portion of the flow chart representing the programming of the system of FIG. 1.

Referring now to FIG. 19, execution proceeds by way of on-page connector 998. In block 1000, valves 486, 502 are opened reconnecting the cylinder to manifolds 450, 460. In decision 1002, controller 20 checks to see if valves 486, 502 are closed. If valves 486, 502 are closed after predetermined time period T32, error condition E32 is declared in block 1006.

In block 1008, a prompt is provided to perform manual leak checks on cylinder valves, check for cold cylinders which indicate a cylinder valve which was not open, and to isolate leaks or cold cylinders. The operator is also prompted to close all manual cylinder valves attached to manifolds 450, 460 and to acknowledge to controller 20 when these tasks are done.

In decision 1010, controller 20 checks if the dual fill flag is set, indicating that a dual fill operation is being executed. If the dual fill flag is set, the process proceeds to block 1012. In block 1012, valves 494,506 are opened. Valves 494,506 isolated small cylinders at the end of manifolds 450,460. In block 1014, controller 20 checks to see if valves 494,506 are open. If after time-out T34, as determined by decision 1016, valves 494,506 are not open, error condition E34 is declared in block 1018. If valves 494,506 are open, processing proceeds to block 1020 where the dual fill flag is reset.

If the dual fill flag is not set, as determined in decision 1010, processing also proceeds to block 1020. In block 1020, controller 20 resets dual fill flag to zero. Processing now proceeds from off-page connector 1022.

Figure 20:
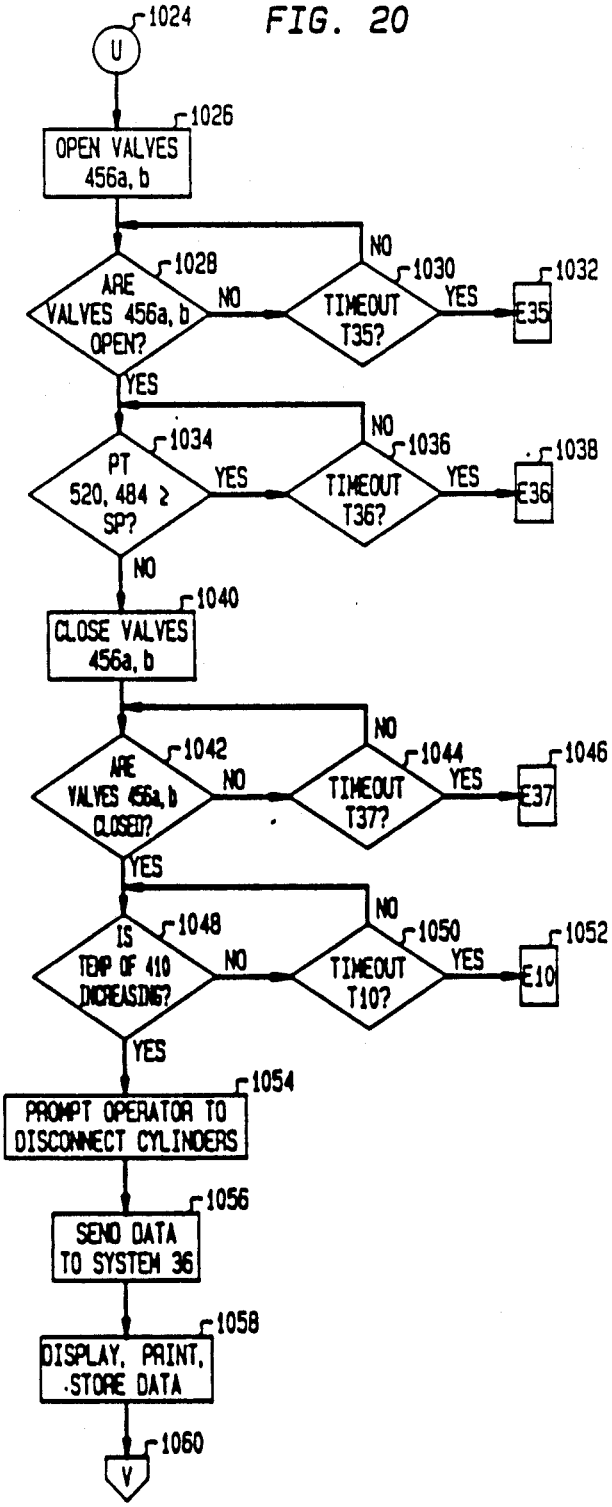
FIG. 20 shows a portion of the flow chart representing the programming of the system of FIG. 1.

Referring now to FIG. 20, execution proceeds by way of on-page connector 1024. In block 1026, valves 456*a,b* are opened allowing manifolds 450,460 to vent to atmosphere. In decision 1028, controller 20 checks to see if valves 456*a,b* are open. If after predetermined time-out period T35, valves 456*a,b* are not open, as determined in decision 1030, error condition E35 is declared in block 1032.

If valves 456*a,b* are open, processing proceeds to decision 1034. In decision 1034, pressure transducers 520,484 are read to determine if the pressure in manifolds 450,460 is greater than pressure transducer 520 setpoint. If after time-out period T36, as determined in decision 1036, pressure detected at pressure transducers 520, 484 is not less than or equal to the setpoints, error condition E36 is raised in block 1038. Simultaneously valves 454*a,b* are checked.

In block 1040, valves 456*a,b* are closed. In decision 1042, controller 20 checks to see if valves 456*a,b* are closed. If after time-out T37, valves 456*a,b* are not closed, as determined by decision in 1044, error condition E37 is declared in block 1046.

In decision 1048, the temperature of temperature sensor 410 located on line 414 is read to determine whether the temperature of line 414 is increasing. If after predetermined time-out period T10, as determined in decision 1050, the temperature in line 414 is not increasing, error condition is declared in block 1052.

In block 1054, controller 20 informs the operator that fill is complete, and instructs the operator to disconnect cylinders from manifolds 450, 460 and to acknowledge this to controller 20. In block 1056, controller 20 sends production data to an external System 36 computer. In block 1058, controller 20 prints, displays, or stores internally the production data from operation of transfill system 10.

Because controller 20 controls and monitors all steps of the loading process, controller 20 can store and output all pertinent production data for inventory, sales and administrative purposes. For example, system 10 can provide the analyzer results for each cylinder loaded to determine whether the contents meet specification. Processing then proceeds to off-page connector 1060 and to initial system sign-on block 604.

The following components have been used for the operation and function as described and shown.

| Reference Numeral | Type |
|---|---|
| 494,506 | Rego 9511R, Foxboro/ Jordan SM-1530 |
| 507 | Minco Thermal Ribbon 5386PD10236A |
| 550 | International Sensor Technology AG 2000 |

We claim:

1. A method for preventing cavitation of a pump in a filling station having a storage tank containing liquefied gas for loading into a gas storage device, the pump having a pump motor, comprising the steps of (a) supplying liquefied gas to the pump for cooling the pump;

(b) sensing the pressure of the storage tank;

(c) sensing the temperature of the cooled pump; and (d) starting the pump motor in response to the sensed pressure and temperature.

2. The method of claim 1 further comprising the steps of:

selecting a low temperature setpoint in response to the sensed pressure of the storage tank;

determining when the sensed temperature has reached the selected low temperature setpoint; and starting the pump motor in response to the temperature determination.

3. The method of claim 1 further comprising the step of evacuating the gas storage devices wherein the evacuation is performed simultaneously with step (a).

4. In a filling station having a storage tank containing liquefied gas and a pump for providing a flow of liquefied gas through a flow of liquefied gas flowpath from the storage tank to a gas storage device, a system for detecting cavitation of the pump comprising:

means in fluid communication with the liquid gas flowpath for determining the absence of fluid flow through the liquefied gas flowpath; and means for providing a cavitation signal in response to the determination during a filling operation.

5. The system of claim 4 wherein the pump includes a pump outlet vent and the liquefied gas flowpath passes through the pump outlet vent in which the determining means is disposed substantially near the pump outlet vent.

6. The system of claim 4 wherein the signal means comprises a flow switch.

7. The system of claim 4 further comprising means for stopping the pump in response to the cavitation signal.

8. A method for detecting cavitation of a pump in a filling station having a storage tank containing liquified gas and a pump for providing a flow of liquified gas through a flow of liquified gas flowpath from the storage tank to a storage device, comprising the steps of:

determining the absence of fluid flow through the liquified gas flowpath by means in fluid communication with the liquefied gas flowpath; and, providing a cavitation signal in response to the determination during a filling operation.

9. The method of claim 8 wherein there is provided a pump outlet vent within the liquefied gas flowpath further comprising the step of disposing the determining means substantially near the pump outlet vent.

10. The method of claim 8 wherein the step of providing a cavitation signal comprises providing a cavitation signal by means of a flow switch.

11. The method of claim 8 further comprising the step of stopping the pump in response to the cavitation signal.

* * * * *